US007148871B2

(12) United States Patent
Sekine

(10) Patent No.: US 7,148,871 B2
(45) Date of Patent: Dec. 12, 2006

(54) LIQUID CRYSTAL DISPLAY DEVICE, LIQUID CRYSTAL DISPLAY DEVICE DRIVING METHOD, AND LIQUID CRYSTAL PROJECTOR APPARATUS

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 527 days.

(21) Appl. No.: 10/656,297

(22) Filed: Sep. 8, 2003

(65) Prior Publication Data

US 2004/0196248 A1 Oct. 7, 2004

(30) Foreign Application Priority Data

Sep. 9, 2002 (JP) ..... 2002/263424

(51) Int. Cl.
*G09G 3/36* (2006.01)
*G09G 5/00* (2006.01)

(52) U.S. Cl. ..... 345/98; 345/99; 345/211

(58) Field of Classification Search ..... 345/87–100, 345/208–211

See application file for complete search history.

(56) References Cited

U.S. PATENT DOCUMENTS 4,779,086 A * 10/1988 Kanno et al. ..... 345/92
6,008,801 A * 12/1999 Jeong ..... 345/204
6,414,668 B1 * 7/2002 Karube et al. ..... 345/98

FOREIGN PATENT DOCUMENTS

JP 10-197894 A 7/1998
JP 2001-228457 A 8/2001

* cited by examiner

*Primary Examiner*—Alexander Eisen
(74) *Attorney, Agent, or Firm*—Sughrue Mion, PLLC

(57) ABSTRACT

A liquid crystal display device driving method wherein pixel signals are supplied to corresponding arrays (each having 6 switches) of a data driver through pixel signal lines with 6 pixel signals of 12 pixel signals as one block. Any set of pixel signals consist of pixel signals having a polarity opposite to that of the pixel signals and pixel signals having a polarity identical to that of the pixel signals. A scanning circuit of the data driver supplies ON/OFF control signals overlapping one another in terms of time between a before block and an after block to the switch arrays. The switch arrays are successively turned ON to apply the pixel signals of blocks to corresponding data lines, respectively. Then, the pixel signals are sampled during turn-OFF of the switch arrays to be held in floating capacities of the data lines, respectively.

38 Claims, 18 Drawing Sheets

LIQUID CRYSTAL DISPLAY DEVICE, LIQUID CRYSTAL DISPLAY DEVICE DRIVING METHOD, AND LIQUID CRYSTAL PROJECTOR APPARATUS

BACKGROUND OF THE INVENTION

1. Fields of the Invention

The present invention relates to a liquid crystal display device and a method of driving the same, and a liquid crystal projector apparatus, and more particularly, to a liquid crystal display device and a method of driving the same, and a liquid crystal projector apparatus, wherein video signals of a sub-frame are made into video signals having a predetermined polarity with respect to an electric potential of a counter electrode of a pixel matrix.

2. Description of the Related Art

Liquid crystal display devices are one type of electronic display device. Liquid crystal display devices having an active matrix type liquid crystal display device and a high performance display quality are generally used as monitors for PCs and liquid crystal display devices for a projector. In the active matrix type liquid crystal display device, TFTs (Thin Film Transistors) as active devices are provided in pixels, respectively, (hereinafter referred to as pixel TFTs) to thereby construct a liquid crystal panel.

A liquid crystal panel using polysilicon TFTs as TFTs of the active matrix type liquid crystal display device has a superior advantage in that a part of a peripheral circuit can be formed on a glass substrate concurrently with the pixel TFTs.

Because of this superior advantage, many liquid crystal panels using the polysilicon TFTs are used in liquid crystal display devices for which miniaturization and high definition are required.

In particular, in a liquid crystal display device for a projector for which high definition equal to or more than 1,024×768 pixels is required in a liquid crystal display device having a diagonal size equal to or smaller than 1 inch (2.54 cm), the only type of liquid crystal display devices utilized are those having a liquid crystal panel using polysilicon TFTs.

High picture quality is required for a liquid crystal display device for a projector in order to enlarge and project small images on a screen having a diagonal size of about 100 inches. This degree of picture quality is equal to or higher than that of a liquid crystal display device for a PC. In order to obtain this high picture quality, it is necessary to increase luminance and contrast.

Generally for driving a liquid crystal device, A.C. driving is used in which the polarity of a voltage applied to a pixel is changed every frame. In accordance with this A.C. driving, it is possible to avoid the disadvantage which occur when a D.C. voltage is applied to liquid crystal molecules.

Generally, the A.C. driving used in the liquid crystal display device for a projector is a gate line inversion driving. This gate line inversion driving is a driving method in which the polarity of a voltage applied to a gate line is alternately changed on every other row of a liquid crystal pixel matrix, and moreover, the polarity thereof is inverted in frames.

In accordance with this driving method, there is provided a superior advantage in that the flicker can be reduced, and moreover, the longitudinal crosstalk due to the leakage currents in pixel TFTs can also be reduced.

However, if a liquid crystal display device is operated by utilizing the gate line inversion driving method, then the video signals applied to pixels belonging to a particular gate line precedingly driven within a pixel matrix are different in polarity from those video signals applied to pixels belonging to a gate line which is subsequently driven. Hence, a large transverse electric field is generated between the pixel electrodes. The transverse electric field in this case means the electric field generated in a direction with which the pixel electrodes extend along a glass substrate or a liquid crystal layer.

The transverse electric field disturbs the orientation of liquid crystal molecules in a pixel boundary portion, thereby causing light leakage. If light leakage is caused, then the contrast is remarkably reduced and the picture quality is degraded.

As means for avoiding generation of the above-mentioned transverse electric field, heretofore, a metal or the like which does not transmit light is arranged in a portion of generation of the above-mentioned light leakage in order to block the leakage light, thereby preventing a reduction in contrast.

The provision of the above-mentioned metal or the like reduces the pixel area and reduces an aperture rate. For this reason, in the liquid crystal display device for a projector requiring a high definition panel in which a pitch of pixels is smaller than 30 μm, the use of metal or the like for avoiding the generation of the transverse electric field becomes a serious problem.

Another means for avoiding the generation of a transverse electric field, is a frame inversion driving method.

This frame inversion driving method is a driving method in which all the polarities of video signals supplied to all pixels within a pixel matrix (hereinafter referred to as pixel signals) are set so as to be identical to one another, and the polarity is inverted every frame.

The description hereinbelow will be given with respect to an example in which a liquid crystal display device using polysilicon TFTs as pixel TFTs is driven by utilizing the frame inversion driving method.

FIG. 1 shows a structure of a liquid crystal display device using polysilicon TFTs as pixel TFTs. This liquid crystal display device is structured so that pixels $PE_{ij}$ in which pixel TFTs (a), storage capacities (b) and pixel electrodes (c) are arranged in intersections between longitudinally distributed data lines $D_j$ (n is one of 1, 2, . . . , n) and transversely distributed gate lines $G_i$ (i is one of 1, 2, . . . , m), respectively, to form a matrix. A data driver circuit 112 and a gate driver circuit 114 are arranged in the periphery of the pixel matrix 116. The data driver circuit 112 is the circuit for driving the data lines, and the gate driver circuit 114 is the circuit for driving the gate lines.

The data driver circuit 112 includes switch arrays $\mathbf{119}_g$ (g is one of 1, 2, . . . , P, and P is the number of blocks) each serving to individually sample pixel signals supplied through 6 video signal wirings (hereinafter referred to as pixel signal lines) S1 to S6 to corresponding six data lines, respectively, and a scanning circuit 121 for supplying ON/OFF control signals $SP_g$ to the switch arrays $\mathbf{119}_g$, respectively. In other words, the data driver circuit 112 is the circuit in which each of the switch arrays $\mathbf{119}_g$ is composed of six analog switches, and which serves to carry out the block division driving for simultaneously sampling six pixel signals supplied through the six pixel signal lines S1 to S6, respectively, with the six analog switches as one unit, i.e., as one block.

Timing charts when the above-mentioned liquid crystal display device for a projector is subjected to the frame inversion driving are shown in FIG. 2 and FIG. 3. FIG. 2 is a timing chart in a frame in which pixel signals each having a polarity positive with respect to an electric potential $V_{com}$ of a counter electrode of the pixels in the pixel matrix are written, and FIG. 3 is a timing chart in a frame in which pixel signals each having a polarity negative with respect to the electric potential $V_{com}$ of the counter electrode of the pixels in the pixel matrix are written.

In FIG. 2 and FIG. 3, DCLK1 and DCLK2 are respectively control clock pulses which are supplied to a shift register (not shown) constituting the scanning circuit 121. The control clock pulse DCLK2 is obtained by inverting the control clock pulse DCLK1. $SP_{g-1}$, $SP_g$ and $SP_{g+1}$ are respectively ON/OFF control signals which are generated from the shift register in the scanning circuit 121 to which the control clock pulses DCLK1 and DCLK2 are supplied.

The pixel signals supplied through the pixel signal wirings S1 to S6 are respectively sampled by the switch arrays $\mathbf{119}_g$ which are turned ON/OFF in accordance with the ON/OFF control signals $SP_g$, respectively, to be outputted to the corresponding six data lines to thereby be used in the display for the pixels.

Japanese published application JP 10-197894 discloses a driving method in which when TFTs for switching are poor in characteristics in a liquid crystal display device for carrying out the block division driving, the number of data lines included in a block is increased to realize the high speed operation.

In addition, a method of manufacturing a polysilicon FET, and a technique for changing a structure to attain a high speed operation for frame inversion driving are described in Japanese published application JP 2001-228457 A.

As described above, the polarities of the pixel signals on the data lines used in display for the pixels are identical to one another within at least one frame time period.

For this reason, if the above-mentioned frame inversion driving is carried out, then a mean value of the pixel signals applied to all the data lines greatly fluctuates depending on the pixel signals. The fluctuation of the mean value causes a difference in the potential fluctuation of the gate lines coupled to the data lines through the parasitic capacities, and the counter electrode. As a result, there is a technical problem in that transverse crosstalk is generated.

In addition, since a mean value of the pixel signals applied to the data lines within one frame (sub-frame) also fluctuates depending on the pixel signals, there is a technical problem in that longitudinal crosstalk is generated.

SUMMARY OF THE INVENTION

An object of the present invention is to provide a liquid crystal display device and a method of driving the same, and a liquid crystal projector apparatus, in each of which the transverse crosstalk and longitudinal crosstalk generate in the conventional frame inversion driving can be greatly reduced.

According to a first aspect of the present invention, a liquid crystal display device driving method wherein the liquid crystal display device comprises a pixel matrix having pixels including gate lines, data lines disposed orthogonally to the gate lines, pixel transistors arranged in intersections between the gate lines and said data lines disposed lengthwise and crosswise, a data driver circuit for supplying video signals from a video signal corresponding to a first pixel time period up to a video signal corresponding to a final pixel time period to different data lines every horizontal time period, a gate driver circuit for supplying a gate signal to a corresponding gate line every horizontal time period, a matrix substrate on which the data driver circuit and the gate driver circuit are formed, a liquid crystal sandwiched between the matrix substrate and a counter substrate on which a counter electrode common to all the pixels on the matrix substrate is arranged, wherein the data driver circuit is comprised by N switching blocks each having M switching elements, a scanning circuit for outputting an open/close control signal for each switching block, and M×P (P is a natural number) video signal wirings forming one set of the M×N video signals from the video signal corresponding to a first pixel time period up to the video signal corresponding to a final pixel time period within the horizontal time period as one set; wherein said M video signal wirings of an i-th set (one of i=1, 2, . . . , P) of the M×P video signal wirings are respectively connected to input terminals of the M switching elements of the i-th switching block, when viewed from the first switching block, every P sets of switching blocks from the first switching block up to the final switching block of the N switching blocks; and wherein said data lines are divided into blocks each having the M data lines, and the M data lines of each block are respectively connected to output terminals of said M switching elements within each of the switching blocks from a first switching block up to a final switching block of the N switching blocks defined in blocks from a first block up to a final block, an outputting step wherein the scanning circuit outputs the open/close control signal synchronously with the M video signals supplied successively every P sets, successively every set of the P sets and simultaneously within the set through the M×P video signal wirings in an arbitrary horizontal time period, a sampling step wherein the M video signals, which are supplied successively every P sets, successively every set of the P sets and simultaneously within the set, being respectively sampled to the M data lines connected to the M switching elements which are caused to simultaneously conduct in the M switching elements of the switching block, and a writing step wherein the M video signals that are sampled individually being respectively written to the M pixels of the set including the M pixel transistors which are caused to simultaneously conduct through the M pixel transistors of the set every set of M pixel transistors which are connected to the gate lines through which the gate driver circuit supplies the gate signal during the arbitrary horizontal time period and which are caused to simultaneously conduct, the method being characterized in that: at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements are to be caused to simultaneously conduct on the heels of M switching elements of the switching block which are formerly caused to simultaneously conduct with the open/close control signal supplied from the scanning circuit; and the M video signals supplied through the M video signal wirings for each set of the P sets are the video signals the polarity of which is changed with respect to the counter electrode between the first time period and a second time period as the remaining time period of the conduction time period following the first time period.

According to a second aspect of the present invention, a liquid crystal display device comprises a pixel matrix having pixels including gate lines, data lines disposed in vertical direction to the gate lines, and pixel transistors arranged in intersections between the gate lines and the data lines disposed lengthwise and crosswise, a data driver circuit for supplying video signals from a video signal corresponding to a first pixel time period up to a video signal corresponding to a final pixel time period to different data lines every horizontal time period, a gate driver circuit for supplying a gate signal to a corresponding gate line every horizontal time period, a matrix substrate on which the data driver circuit and the gate driver circuit are formed, a liquid crystal sandwiched between the matrix substrate and a counter substrate on which a counter electrode common to all the pixels on the matrix substrate is arranged, wherein the data driver circuit is comprised by N switching block each having M switching elements, a scanning circuit for outputting an open/close control signal for each switching block, and M×P (P is a natural number) video signal wirings forming one set of said M×N video signals from the video signal corresponding to a first pixel time period up to the video signal corresponding to a final pixel time period within the horizontal time period as one set; □ said M video signal wirings of an i-th set (one of i=1, 2, . . . , P) of the M×P video signal wirings are respectively connected to input terminals of the M switching elements of the i-th switching block, when viewed from the first switching block, every P sets of switching blocks from the first switching block up to the final switching block of the N switching blocks; and wherein said data lines are divided into blocks each having the M data lines, and the M data lines of each block are respectively connected to output terminals of said M switching elements within each of the switching blocks from a first switching block up to a final switching block of the N switching blocks defined in blocks from a first block up to a final block, the scanning circuit for outputting the open/close control signal synchronously with the M video signals supplied successively every P sets, successively every set of the P sets and simultaneously within the set through the M×P video signal wirings in an arbitrary horizontal time period, the M video signals, which are supplied successively every P sets, successively every set of the P sets and simultaneously within the set, being respectively sampled to the M data lines connected to the M switching elements which are caused to simultaneously conduct in the M switching elements of the switching block, and the M video signals that are sampled individually being respectively written to the M pixels of the set including the M pixel transistors which are caused to simultaneously conduct through the M pixel transistors of the set every set of M pixel transistors which are connected to the gate lines through which the gate driver circuit supplies the gate signal during the arbitrary horizontal time period and which are caused to simultaneously conduct, wherein at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements are to be caused to simultaneously conduct on the heels of M switching elements of the switching block which are formerly caused to simultaneously conduct with the open/close control signal supplied from the scanning circuit; and wherein the M video signals supplied through the M video signal wirings for each set of the P sets are the video signals the polarity of which is changed with respect to the counter electrode between the first time period and a second time period as the remaining time period of the conduction time period following the first time period.

According to the present invention, in the sub-frame inversion driving method using the pixel signals of the positive or negative polarity with respect to the electric potential of a counter electrode constituting the pixel matrix, there is carried out the block sequential driving in which there is repeatedly carried out every block the operation in which: the pixel signals of a predetermined number of phases are divided into a predetermined number of blocks; for a time period which does not substantially participate in the display of the predetermined number of pixel signals within each block, the pixel signals of the polarity opposite to the pixel signals of the positive or negative polarity with respect to the electric potential of the counter electrode are applied to the data lines, respectively; the pixel signals of the positive or negative polarity with respect to the electric potential of the counter electrode continue to be applied to the data lines, respectively, until a time instant of the sampling after a lapse of the above-mentioned time period; and the pixel signals of the positive or negative polarity with respect to the electric potential of the counter electrode are sampled at a time instant of the sampling to be held in the floating capacities of the corresponding data lines, respectively, whereby the pixel signals held in the data lines, respectively, are held in the corresponding pixel electrodes and storage capacities, respectively, to thereby cause the display on the pixels.

As a result, when the pixel signals of the positive or negative polarity with respect to the electric potential of the counter electrode constituting the pixel matrix are written to the pixels through the data lines, respectively, the fluctuation of the signal voltages on the data lines is averaged to reduce quantities of voltage fluctuations of all the data lines.

Consequently, the transverse crosstalk which is caused in the conventional frame inversion driving is greatly reduced.

In addition, as described above, prior to the application of the pixel signals to the data lines defined in blocks, the pixel signals of the polarity opposite thereto are necessarily applied to the corresponding data lines, respectively, a predetermined number of times for the horizontal time period. Thus, the same effects as those in the conventional precharge driving are obtained without taking a special precharge time period, and hence the longitudinal crosstalk is greatly reduced.

In addition, before a time instant when a predetermined number of pixel signals of a preceding block are sampled to the data lines, respectively, by a predetermined time period, the above-mentioned predetermined number of pixel signals of the same polarity of a block just following the preceding block are applied to the data lines, respectively. Thus, it is possible to greatly reduce signals (noises) which burst from the data line belonging to a block just following a preceding block into the data line belonging to a preceding block adjacent to that data line concerned, and also it is possible to largely reduce the generation of the longitudinal streak nonuniformity.

Moreover, in addition to the above-mentioned effects, the flicker becomes difficult to be detected since one frame is divided into a predetermined number of sub-frames in order to drive the pixel matrix.

Further, the reduction in voltage due to the leakage currents of the pixel TFTs as a factor of generation of the flicker becomes small as the frame time period becomes so short as the sub-frame time period. The reduction in voltage is decreased, whereby the level of the flicker can be suppressed to a low level and the reduction of the flicker can be synergistically attained.

While these effects are achieved, enhancement of an aperture ratio obtained in the frame inversion driving is obtained at the same time.

One frame is divided into a predetermined number of sub-frames in order to drive the pixel matrix so that the same pixel signals are written to the same pixel electrodes a predetermined number of times. Consequently, the effect in which even if a capacity change is generated in the pixel capacities, the insufficient electric charges are filled up to prevent a decrease in strength of the electric field applied to the liquid crystal layer to thereby enhance the operating speed of the liquid crystal.

DETAILED DESCRIPTION OF THE INVENTION

Illustrative, non-limiting embodiments of the present invention will hereinafter be described with reference to the accompanying drawings.

[First Embodiment]

Figure 1:
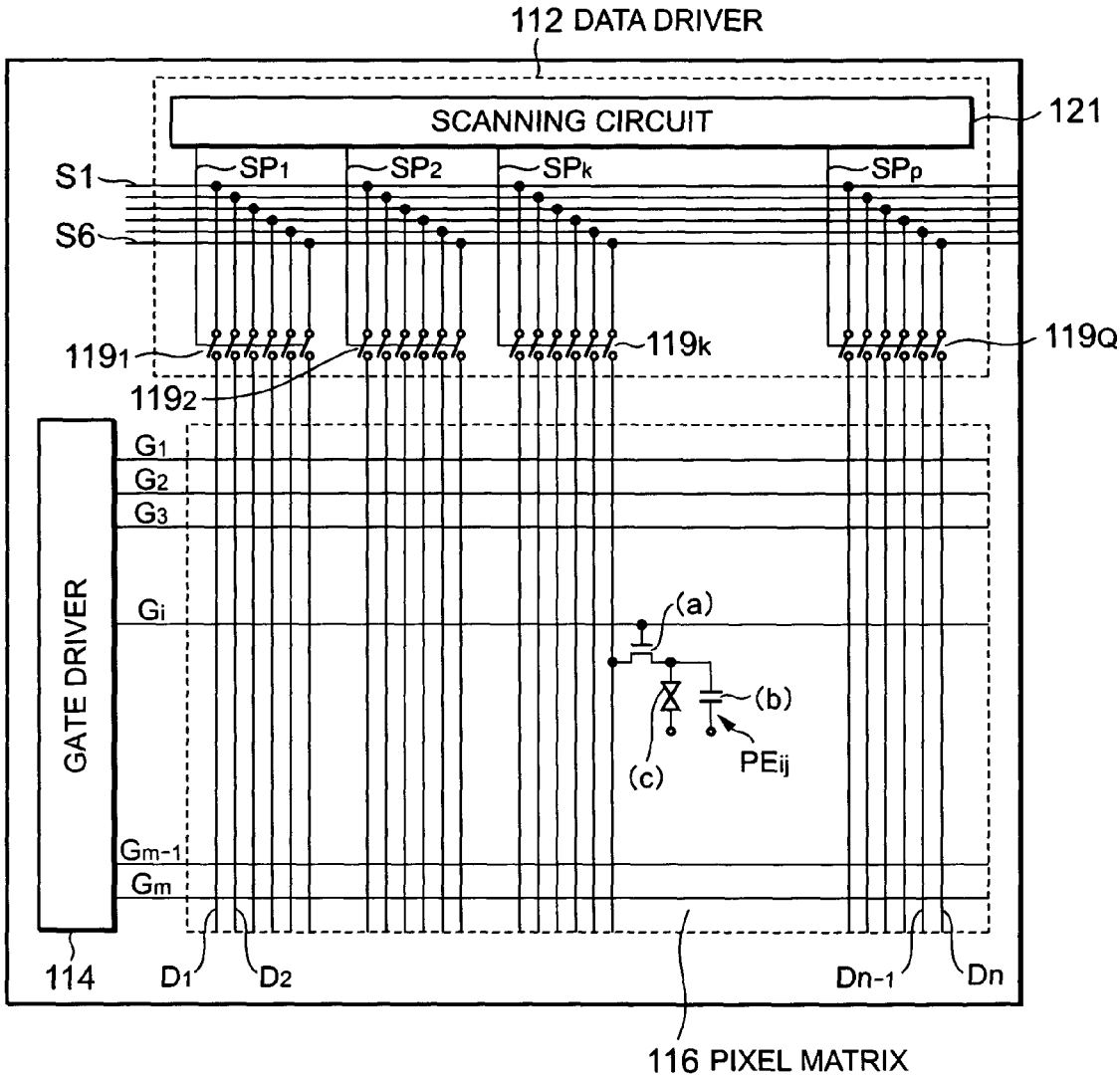
FIG. 1 is a diagram showing a configuration of the conventional liquid crystal display device.
Figure 2:
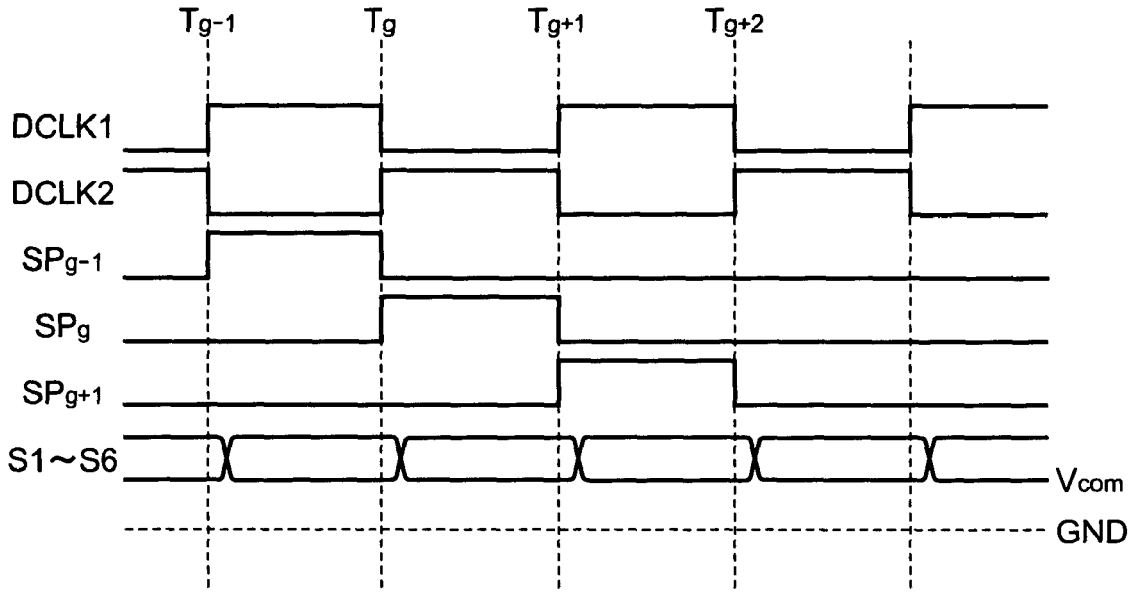
FIG. 2 is a detailed timing chart of a data driver of the liquid crystal display device, and a timing chart with which pixel signals of a positive polarity with respect to an electric potential of a counter electrode are supplied to a pixel matrix.
Figure 3:
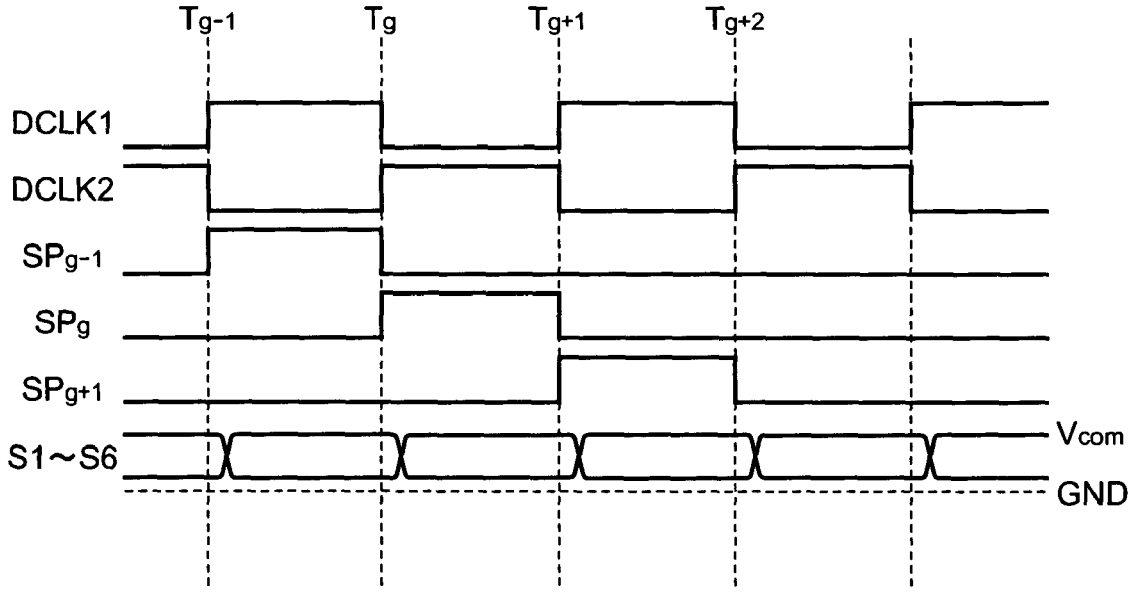
FIG. 3 is a detailed timing chart of a data driver of the liquid crystal display device, and a timing chart with which pixel signals of a negative polarity with respect to the electric potential of a counter electrode are supplied to a pixel matrix.
Figure 4:
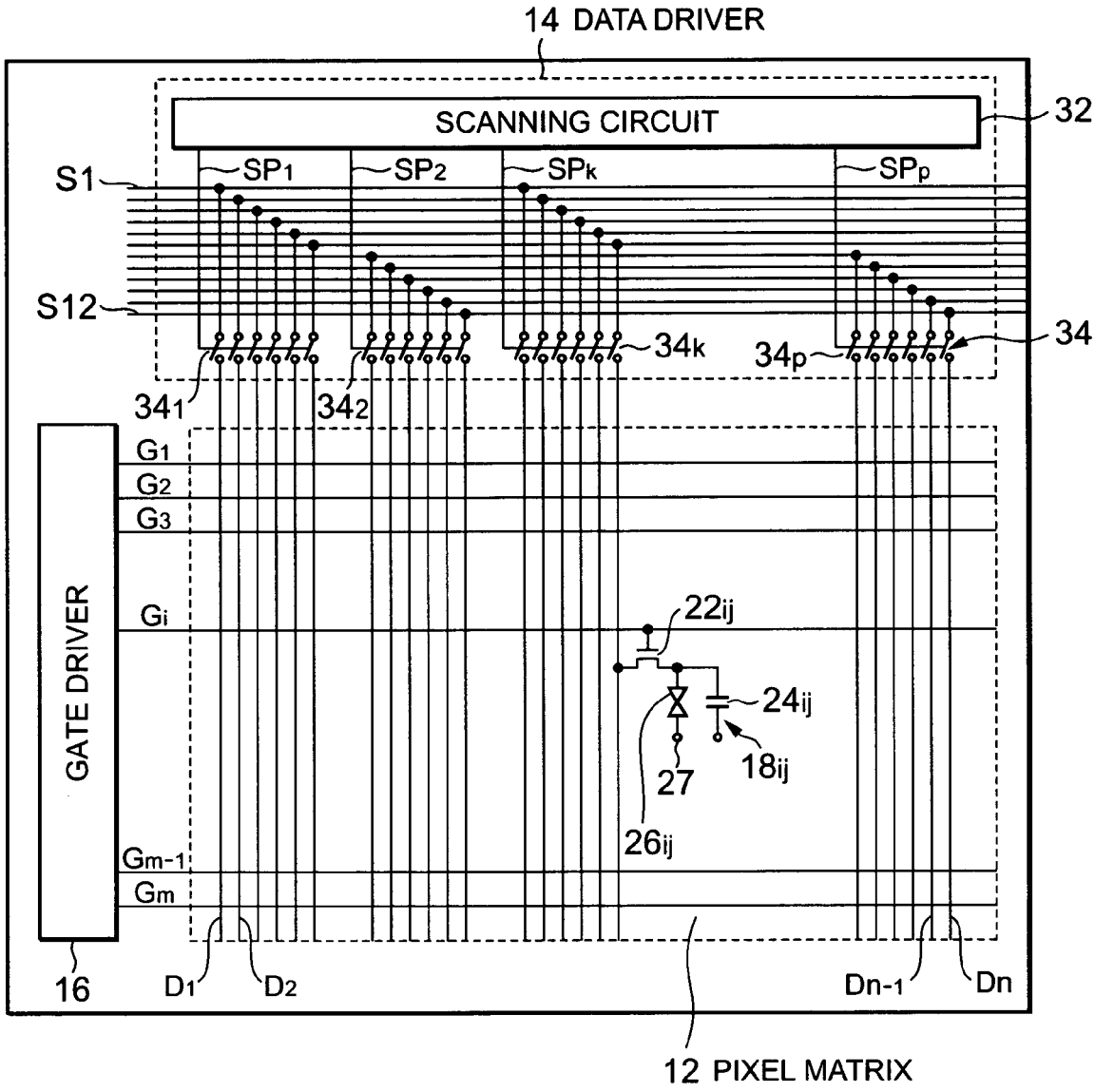
FIG. 4 is a diagram showing a configuration of a liquid crystal display device according to a first embodiment of the present invention.
Figure 5:
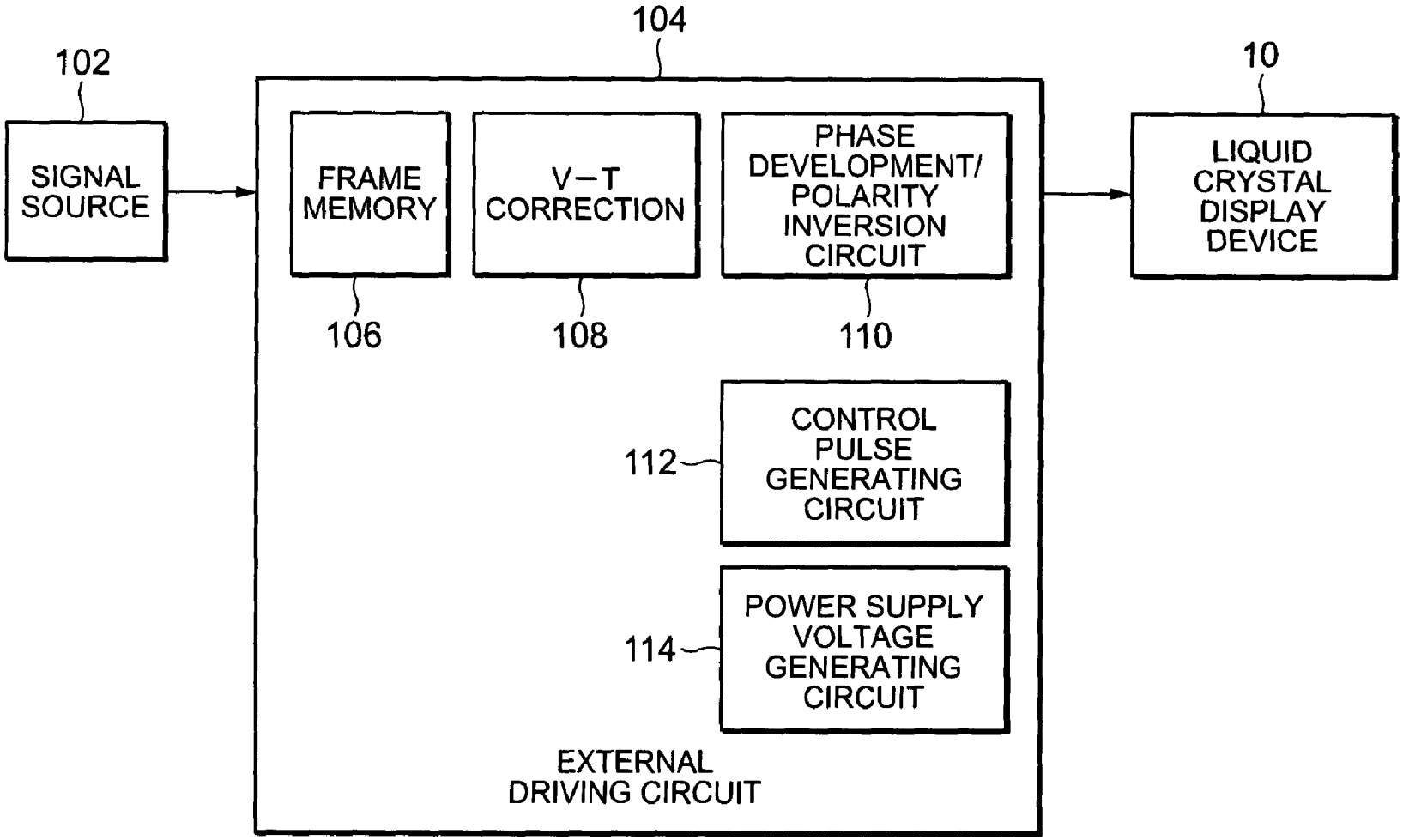
FIG. 5 is a diagram showing an external driving circuit for supplying signals to the liquid crystal display device.

An active matrix type liquid crystal display device 10 according to a first embodiment (hereinafter referred to as a liquid crystal display device) comprises a pixel matrix 12, a data driver 14, and a gate driver 16 as shown in FIG. 4. In the crystal display device 10, a pixel matrix is subjected to sub-frame inversion driving, and when the pixel matrix is subjected to block sequential driving every sub-frame, pixel signals each having a polarity opposite to that of pixel signals, and pixel signals each having an original polarity are applied to data lines within a block concerned, respectively, and the pixel signals each having the original polarity are sampled to be held in floating capacities of the corresponding data lines, respectively. Thereby, it is possible to drastically reduce generation of transverse crosstalk, longitudinal crosstalk and the like due to the conventional frame inversion driving. The liquid crystal display device 10, as shown in FIG. 5, is supplied with pixel signals, a control pulse and a power source voltage from a signal source (a personal computer (PC) or the like) 102 through an external driving circuit 104.

The pixel signals supplied from the signal source 102 are temporarily written to a frame memory 106 and then read out therefrom. A reading speed is a speed at which one frame can be divided into a predetermined number of sub-frames. If the number of sub-frames is 4, then the reading speed is four times as high as the writing speed. In an illustrative embodiment of the present invention, the number of sub-frames is 4.

Pixel signals which have been read out at a high speed from the frame memory 106 are subjected to V-T correction for correcting nonlinear distortion of an applied voltage-transmittance of liquid crystal and the γ correction for picture quality adjustment in a V-T correction/γ correction circuit 108. Each of the pixel signals for which these corrections have been made is time-divided into signals of 12 phases every sub-frame in a phase development/polarity inversion circuit 110 to be outputted.

The format of the signal which is subjected to the time division in the phase development/polarity inversion circuit 110 is such that with respect to the first six phases of 12 phases, 6 pixel signals in a horizontal direction are simultaneously outputted (in parallel with one another), and next, with respect to the latter half 6 phases, next 6 pixel signals in the horizontal direction are simultaneously outputted. This process is sequentially continued up to the final pixel signal in the horizontal direction every 12 pixel signals.

The above-mentioned "next" means a relationship in which at a time instant after a lapse of a half period of a period of a first horizontal clock pulse DCK1 (which is described later) from a time instant of a start of a signal time period tP of 6 pixel signals contained in a sequential block and are to be simultaneously outputted, 6 pixel signals which are contained in a block just following the block concerned which are to be simultaneously outputted are started to be outputted.

Then, the same time division output operation for every 6-pixel signals in the horizontal direction is successively carried out every 6 pixel signals in the horizontal direction. The 6 pixel signals become the pixel signals, which are to be applied to 6 data lines (block), respectively, which will be described in more detail below.

Every 6 pixel signals will be successively written as one block to the pixel matrix 12 of the liquid crystal display device 10. When writing one block, sampling by corresponding switch array that will be described later is carried out. Then, switch ON-time when the switch array concerned is held in an ON state is $t_{on2}$ (which is described later).

For the front time period of the switch ON-time $t_{on2}$, the above-mentioned 6 pixel signals inputted in parallel with one another each have a polarity opposite to that of 6 pixel signals each having a positive polarity with respect to an electric potential of a counter electrode 27 of the pixel matrix 12. For a time period from a time instant after an elapse of the above-mentioned front time period to a time instant of end of the above-mentioned switch ON-time $t_{on2}$, the above-mentioned 6 pixel signals inputted in parallel with one another are the pixel signals each have a positive polarity with respect to the electric potential of the counter electrode 27 of the pixel matrix 12.

The pixel signals of 12 phases having such a signal format are supplied from the phase development/polarity inversion circuit 110 to the liquid crystal display device 10.

In response to a horizontal synchronous signal VSYNC for video signals, a start pulse DSTP for a horizontal direction, a first clock pulse for a horizontal direction (called a first horizontal clock pulse) DCK1, a second clock pulse for a horizontal direction (called a second horizontal clock pulse) DCK2, a first decode pulse (called a first horizontal decode pulse) DEC1, and a second decode pulse for a horizontal direction (called a second horizontal decode pulse) DEC2 are generated from the control pulse generating circuit 112. Also, in response to a vertical synchronous signal VSYNC for video signals, a start pulse GSTP for a vertical direction, a first clock pulse for a vertical direction (called a first vertical clock pulse) GCK1 and a second clock pulse for a vertical direction (called a second vertical clock pulse) GCK2 are generated from the control pulse generating circuit 112. These pulse signals are all supplied to the liquid crystal display device 10.

The first horizontal clock pulse DCK1 has a period of $2T_H/P+1$ ($T_H$ is a horizontal time period of a sub-frame, and P is the number of blocks which is described later). The second horizontal clock pulse DCK2 is generated by inverting the first horizontal clock pulse DCK1 (refer to DCK1 and DCK2 of FIG. 9).

In addition, the first horizontal decode pulse DEC1 has the same period as that of the first horizontal clock pulse DCK1, and its leading edge is identical to a leading edge of the first horizontal clock pulse DCK1. When a time period when the first horizontal decode pulse DEC1 rises to be held at the high level is determined as the above-mentioned switch-ON time $t_{on2}$ (in FIG. 9, time instants of its start are $T_{k-1}$, $T_k$, $T_{k+1}$ and the like, and time instants of its end are $T'_{k-1}$, $T'_k$, $T'_{k+1}$ and the like), the first horizontal clock pulse DCK1 is held at the low level for a time period $t_c$ from a time instant of end of the switch-ON time $t_{on2}$ up to a time instant of end of the period of the first horizontal clock pulse DCK1.

The second decode pulse DEC2 has the same period as that of the second horizontal clock pulse DCK2, and its leading edge is identical to a leading edge of the second horizontal clock pulse DCK2. Also, when a time period when the second decode pulse DEC2 rises to be held at the high level is determined as the above-mentioned switch-ON time $t_{on2}$, the second decode pulse DEC2 is held at the low level for a time period $t_c$ from a time instant of end of the switch-ON time $t_{on2}$ to a time instant of end of the period of the second horizontal clock pulse DCK2.

Figure 7:
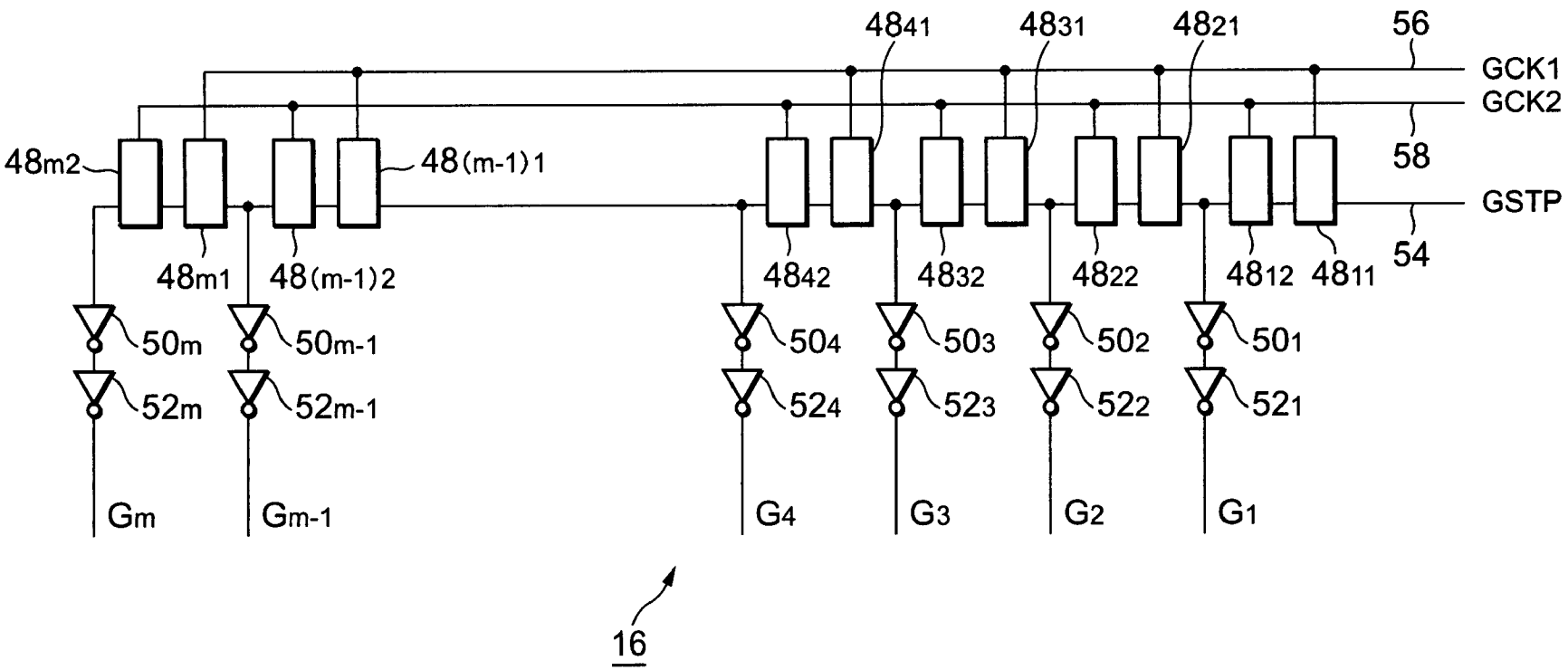
FIG. 7 is a diagram showing a configuration of a gate driver of the liquid crystal display device.

As shown in FIG. 7, the first vertical clock pulse GCK1 is generated so as to have a time period (corresponding to a period) which is obtained by dividing the vertical time of a sub-frame by the number of gate lines. The second vertical clock pulse GCK2 is generated by inverting the first vertical clock pulse GCK1.

A power source voltage generating circuit 114 is a circuit for generating various voltages to be supplied to the pixel matrix 12, the data driver 14 and the gate driver 16 of the liquid crystal display device 10.

As shown in FIG. 4, the data driver 14 and the gate driver 16 are formed in the periphery of the pixel matrix 12 on a matrix substrate constituting the pixel matrix 12. The counter electrode common to all the pixels on the matrix substrate is arranged on a counter substrate, and liquid crystal is sandwiched between the matrix substrate and the counter substrate.

The pixel matrix 12 of the liquid crystal display device 10 is formed by arranging pixels $\mathbf{18}_{ij}$ in intersections between data lines $D_j$ (j is one of 1, 2, . . . , n) which are longitudinally arranged and gate lines $G_i$ (i is one of 1, 2, . . . , m) which are transversely arranged. The pixels $\mathbf{18}_{ij}$ are constituted by pixel TFTs $\mathbf{22}_{ij}$, storage capacities $\mathbf{24}_{ij}$, and pixel electrodes $\mathbf{26}_{ij}$. Drains of the pixel TFTs $\mathbf{22}_{ij}$ are connected to the data lines $D_j$, gates thereof are connected to the gate lines $G_i$, and sources thereof are connected to one electrodes of the pixel electrodes $\mathbf{26}_{ij}$ and the storage capacities $\mathbf{24}_{ij}$, respectively. An electric potential $V_{com}$ of the counter electrode is powered to the other electrodes of the counter electrode 27 and the storage capacities $\mathbf{24}_{ij}$.

The data driver 14 includes a scanning circuit 32 for outputting an ON/OFF control signal $SP_k$ every 6 data lines (corresponding to the above-mentioned block) $B_{(k-1)+1}$ (k is one of 1, 2, . . . , P, P is the number of blocks and 1 is one of 1, 2, . . . , 6), a switch array 34 having P switch arrays $\mathbf{34}_k$ each adapted to simultaneously turn ON/OFF 6 switches in accordance with the ON/OFF control signal $SP_k$, 12 video signal wirings (hereinafter referred to as pixel signal lines) S1 to S12. The pixel signal lines S1 to S6 of the 12 pixel signal lines S1 to S12 are respectively connected to input terminals of the 6 switches of each of the odd numbered switch arrays, and the pixel signal lines S7 to S12 of the 12 pixel signal lines S1 to S12 are respectively connected to input terminals of the 6 switches of each of the even-numbered switch arrays.

Any of the pixel signal lines supplies therethrough a video signal corresponding to a pixel time period (hereinafter referred to as a pixel signal), and thus, the 12 pixel signal lines S1 to S12 successively supply therethrough the pixel signals from the first pixel signal up to the final pixel signal every two blocks described above and every horizontal time period.

Then, 6 output terminals of the 6 switches of each of the odd-numbered switch arrays are respectively connected to the data lines corresponding to each of the odd-numbered blocks, and 6 output terminals of the 6 switches of each of the even-numbered switch arrays are respectively connected to the data lines corresponding to each of the even-numbered blocks.

The scanning circuit 32 includes a DFF circuit 36 having P D type flip-flop circuits (hereinafter referred to as DFFs) constituting a shift register and connected to one another in a cascade style, and a waveform shaping circuit 38.

Figure 6:
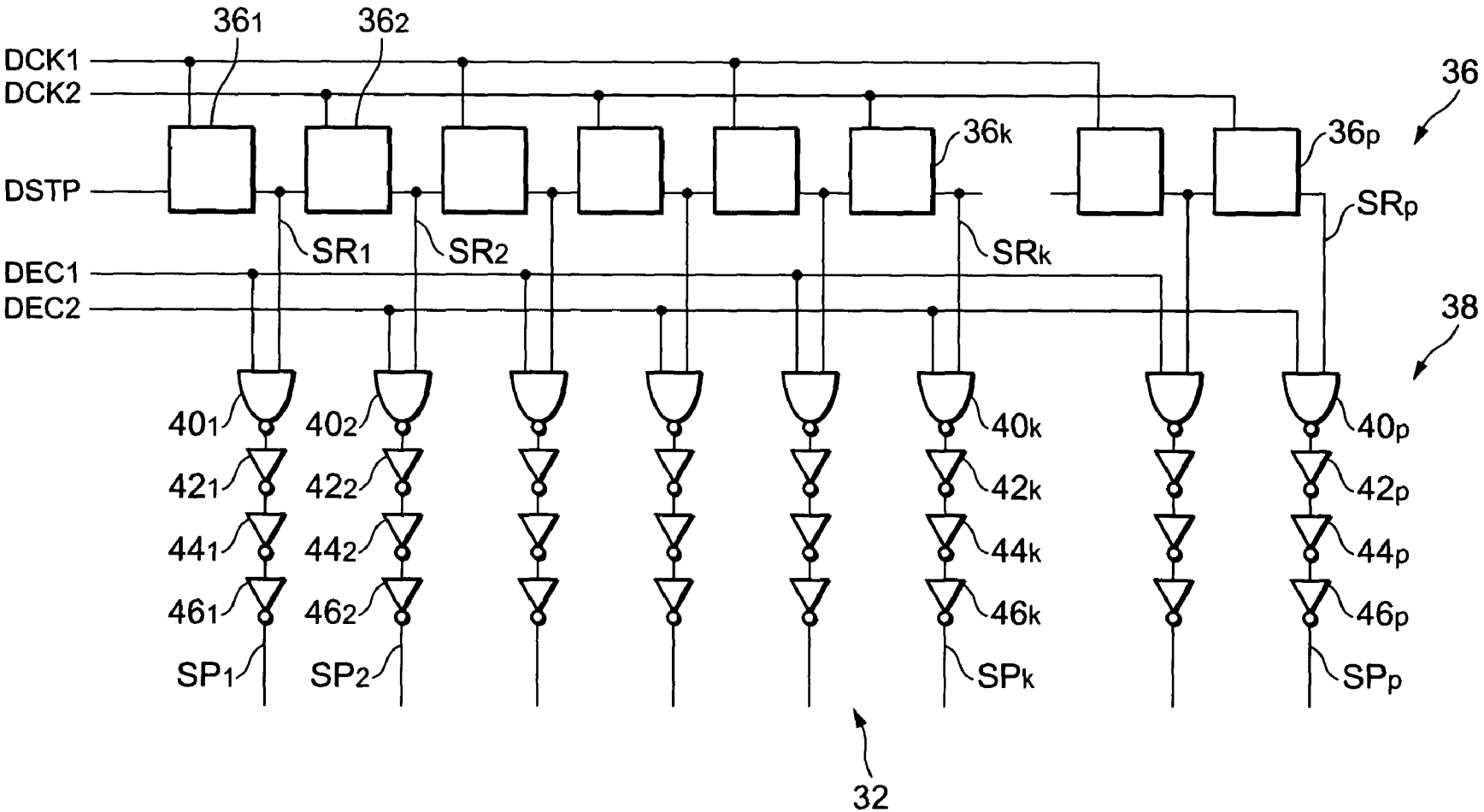
FIG. 6 is a diagram showing a configuration of a data driver of the liquid crystal display device.

As shown in FIG. 6, a start pulse DSTP is supplied to the first stage DFF $\mathbf{36}_1$ of the P DFFs $\mathbf{36}_k$ connected to one another in a cascade style. A period of the start pulse DSTP becomes a horizontal time period when the pixel signals for one row of the sub-frame are written to the pixels for one row of the pixel matrix.

Then, a first control clock pulse DCK1 is supplied to each of the odd-numbered DFFs of the cascade-connected P DFFs $\mathbf{36}_k$, and a second control clock pulse DCK2 is supplied to each of the even-numbered DFFs.

The waveform shaping circuit 38, as shown in FIG. 6, includes one NAND circuit $\mathbf{40}_k$ which is arranged so as to correspond to the cascade-connected P DFFs $\mathbf{36}_k$, and three stages of inverters $\mathbf{42}_k$, $\mathbf{44}_k$ and $\mathbf{46}_k$ which are cascade-connected every NAND circuit $\mathbf{40}_k$.

A first horizontal decode pulse DEC1 is supplied from the control pulse generating circuit 112 of the external driving circuit 104 (FIG. 5) to each of the odd-numbered NAND circuits $\mathbf{40}_k$, and a second horizontal decode pulse DEC2 is supplied from the control pulse generating circuit 112 of the external driving circuit 104 to each of the even-numbered NAND circuits $\mathbf{40}_k$.

As described above, a timing of the first horizontal clock pulse DCK1 and a timing of the fist horizontal decode pulse DEC1 are set so that a trailing edge of the fist horizontal decode pulse DEC1 occurs before a leading edge within a period of a next first horizontal clock pulse by a predetermined time period $t_c$.

Accordingly, a time period when the first horizontal decode pulse DEC1 is held at the high level is shorter than a time period of the first horizontal clock pulse by the predetermined time period $t_c$.

A relationship between the fist horizontal clock pulse DCK1 and the first horizontal decode pulse DEC1 is also applied to a relationship between the second horizontal clock pulse DCK2 and the second horizontal decode pulse DEC2.

However, the leading edges of the fist horizontal decode DEC1 and the second horizontal decode pulse DEC2 are regulated by the leading edge of the first horizontal clock pulse DCK1 and the leading edge of the second horizontal clock pulse DCK2, respectively. Hence, the fist horizontal decode pulse DEC1 and the second horizontal decode pulse DEC1 are shifted in turn from each another by a half period of a period of each of the first horizontal clock pulse DCK1 and the second horizontal clock pulse DCK2.

Output terminals of the P inverters $\mathbf{46}_k$ are connected to control input terminals of the corresponding switch array $\mathbf{34}_k$, respectively.

As shown in FIG. 7, the gate driver 16 includes cascade-connected 2m DFFs $\mathbf{48}_{i1}$ and $\mathbf{48}_{i2}$ (i is one of 1, 2, . . . , m, and m is the number of gate lines), and two stages of inverters $\mathbf{50}_i$ and $\mathbf{52}_i$ which are cascade-connected to nodes between output terminals of the DFFs $\mathbf{48}_{i2}$ and input terminals of the DFFs $\mathbf{48}_{(i+1)1}$, respectively. Output terminals of the inverters $\mathbf{52}_i$ are connected to the gate lines $_{Gi}$, respectively.

A start pulse line 54 of a sub-frame is connected to a data input terminal of the first DFF$\mathbf{48}_{11}$, and a first vertical clock pulse line 56 with respect to the sub-frame is connected to a clock input terminal thereof. An output terminal of the DFF$\mathbf{48}_{11}$, is connected to a data input terminal of the DFF$\mathbf{48}_{12}$, and a second vertical clock pulse line 58 with respect to the sub-frame is connected to a clock input terminal thereof.

Hereinbelow, similarly, output terminals of the DFFs $\mathbf{48}_{(i-1)2}$ of the preceding stages are connected to data input terminals of the cascade-connected odd-numbered DFFs $\mathbf{48}_{i1}$ (i in this case is one of 2'. . . ; m), respectively, and a first horizontal clock pulse line 56 is connected to clock input terminals thereof.

In addition, outputs of the DFFs $\mathbf{48}_{i1}$ of the preceding stages are connected to data input terminals of the cascade-connected even-numbered DFFs $\mathbf{48}_{i1}$ (i in this case is one of 2, . . . , m), and a second vertical clock pulse line 58 is connected to clock input terminals thereof.

Next, an operation of this embodiment will hereinbelow be described with reference to FIGS. 4 to 10.

In this embodiment, the pixel signals for one frame are divided into predetermined, e.g., 4 sub-frames in the phase development/polarity inversion circuit 110, and the pixel signals for two blocks are supplied to every sub-frame through the pixel signal lines S1 to S12 in accordance with the time division format as described above.

Upon start of the operation of the data driver 14, DFF$\mathbf{36}_1$, DFF$\mathbf{36}_2$, . . . , DFF$\mathbf{36}_{Q+1}$ are reset, and signals at the low level are outputted from their output terminals, respectively.

The start pulse DSTP, and the first horizontal clock pulse DCK1 and the second horizontal clock pulse DCK2 which regulate the above-mentioned blocks, the first horizontal decode pulse DEC1 and the second decode pulse DEC2 are supplied from the control pulse generating circuit 112 to the data driver 14.

In addition, the start pulse GSTP, the first vertical clock pulse GCK1 and the second vertical clock pulse GLK2 are supplied from the control pulse generating circuit 112 to the gate driver 16.

In the data driver 14 to which the start pulse DSTP, the first horizontal clock pulse DCK1 and the second horizontal clock pulse DCK2, the first horizontal decode pulse DEC1 and the second horizontal decode pulse DEC2 are supplied, in response to a first leading edge of the first horizontal clock pulse DCK1, the start pulse DSTP is set in DFF$\mathbf{36}_1$. As a result, an output signal SR1 of the DFF$\mathbf{36}_1$ makes transition from the low level to the high level.

Then, since upon supply of a second leading edge of the first horizontal clock pulse DCK1 (forward transition) to DFF$\mathbf{36}_1$, the start pulse DSTP goes to a low level so that DFF$\mathbf{36}_1$ is set to the low level, an output signal $SR_1$ of DFF$\mathbf{36}_1$ goes to the low level at a time instant of the above-mentioned forward transition. This output signal SR1 is left at the low level until a next start pulse DSTP is inputted.

This is also applied to each of DFFs in and after DFF$\mathbf{36}_2$. However, output signals of DFFs of the preceding stages are supplied to data input terminals of DFFs, respectively.

Figure 9:
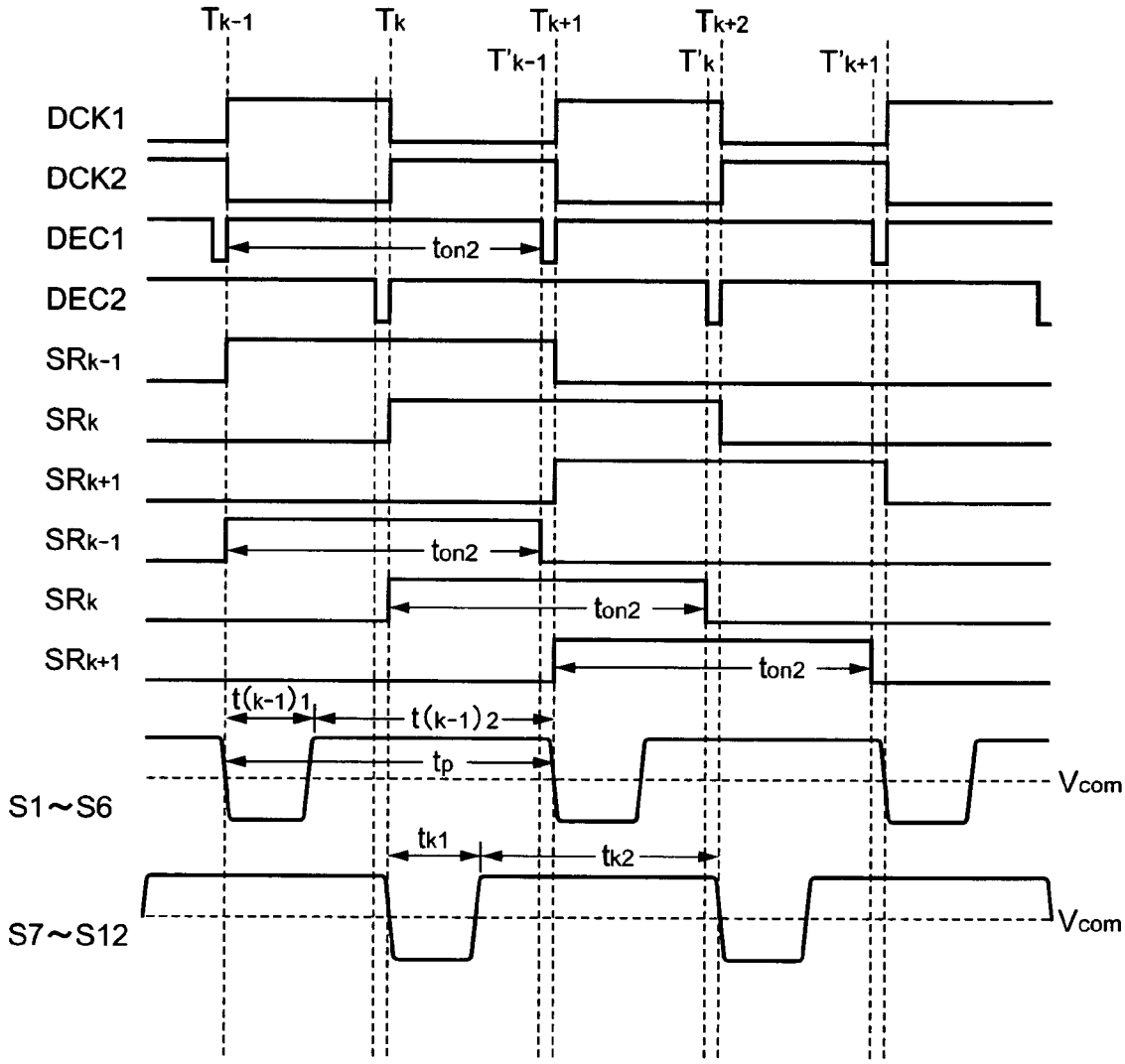
FIG. 9 is a detailed timing chart of the data driver of the liquid crystal display device, and a timing chart with which pixel signals of a positive polarity with respect to an electric potential of a counter electrode are applied to a pixel matrix.

Output signals from $DFF_{k-1}$, $DFF_k$ and $DFF_{k+1}$ of DFFs are shown in the form of $SR_{k-1}$, $SR_k$ and $SR_{k+1}$ of FIG. 9, respectively. $SR_{k-1}$, $SR_k$ and $SR_{k+1}$ of FIG. 9 exhibit output signals of (k−1)-th DFF $\mathbf{36}_{k-1}$, k-th DFF $\mathbf{36}_k$ and (k+1)-th odd-numbered DFF $\mathbf{36}_{r+1}$ of the cascade-connected $k_D$FFs, respectively.

Logical products between output signals $SR_1$, $SR_3$, . . . outputted from the odd-numbered DFFs of DFF$\mathbf{36}_1$, DFF$\mathbf{36}_2$, . . . , DFF$\mathbf{36}_p$, and a first horizontal decode pulse DEC1 are carried out in the corresponding NAND circuits $\mathbf{40}_1$, $\mathbf{40}_3$, . . . , respectively, and logical products between output signals $SR_2$, $SR_4$, . . . , outputted from the even-numbered DFFs of DFF$\mathbf{36}_1$, DFF$\mathbf{36}_2$, . . . , DFF$\mathbf{36}_p$, and a second horizontal decode pulse DEC2 are carried out in the corresponding NAND circuits $\mathbf{40}_2$, $\mathbf{40}_4$, . . . , respectively.

In such a manner, the signal which has been outputted from the NAND circuits $\mathbf{40}_1$,$\mathbf{40}_2$, . . . , $\mathbf{40}_p$ after carrying out the logical product concerned therewith in the NAND circuits $40_1$, $40_2$, . . . , $40_p$ is outputted in the form of ON/OFF control signal $SP_k$ from the inverter $46_k$ through three stages of inverters $42_k$, $44_k$ and $46_k$ cascade-connected to the corresponding NAND circuit.

Since the first horizontal clock pulse DCK1 and the first horizontal decode pulse DEC1 are set so as to meet the timing relationship as described above, the leading edges of the odd-numbered ON/OFF control signals $SP_1$, $SP_3$, . . . of the ON/OFF control signals $SP_1$, $SP_2$, . . . , $SP_p$, as shown in FIG. 6, agree with the leading edges of the first horizontal clock pulse DCK1, respectively. Then, any of the trailing edges of the first horizontal clock pulse occurs before a leading edge within a period of a next first horizontal clock pulse by a predetermined time period $t_c$.

This relationship is also applied to a relationship between a leading edge and a trailing edge of the even-numbered ON/OFF control signals $SP_2$, $SP_4$, . . . , and a leading edge of a second horizontal clock pulse and a leading edge of a horizontal clock pulse next to that second horizontal clock pulse.

The ON/OFF control signals $SP_1$, $SP_2$, . . . , $SP_p$ are supplied to the corresponding switch arrays $34_1$, $34_2$, . . . , $34_p$ to turn ON/OFF the switches of the switch arrays concerned, respectively.

A time period from turn-ON of the switches of the switch array $34_1$ to turn-OFF of the switches of the switch array $34_p$ corresponds to one horizontal time period of one sub-frame. For the horizontal time period, the gate pulses are supplied from the gate driver 16 to the corresponding gate lines. These gate pulses are illustrated as $G_{i-1}$, $G_i$, and $G_{i+1}$ in FIG. 5, and as $G_1$, $G_2$, $G_3$, . . . , $G_m$ in FIG. 10.

Next, an operation of the gate driver 16 will be described hereinbelow. Upon start of the operation of the gate driver 16, DFF$48_{11}$, DFF$48_{12}$, . . . , DFF$48_{m1}$, DFF$48_{m2}$ are reset, and a signal at a low level is supplied to each of their output terminals.

A start pulse GSTP which is obtained by dividing a vertical time period of a vertical pulse VSYNC regulating a vertical time period of the pixel signals for one frame (the pixel signals for one screen) into four parts is supplied from the control pulse generating circuit 112 through the start pulse line 54.

In addition, the first vertical clock pulse GCK1 and the second vertical clock pulse GCK2 are supplied from the above-mentioned control pulse generating circuit 112 through the first vertical clock pulse line 56 and the second vertical clock pulse line 58, respectively.

Initially, The start pulse GSTP inputted to a data input terminal of the DFF$48_{11}$, is set in DFF$48_{11}$, with a leading edge of the first vertical clock pulse GCK1, and then is set in DFF$48_{12}$ with the second vertical clock pulse GCK2.

Since the start pulse GSTP goes to a low level until the next first vertical clock pulse GCK1 rises, DFF$48_{11}$, is set and a signal at a high level generated at an output terminal of DFF$48_{11}$, becomes a signal at the low level with a leading edge of a next first vertical clock pulse GCK1.

At the time when an output signal of DFF $48_{11}$ has become the low level and a next second vertical clock pulse GCK2 has risen, DFF$48_{12}$ is set and a signal at the high level generated at the output terminal thereof becomes a signal at the low level.

Figure 10:
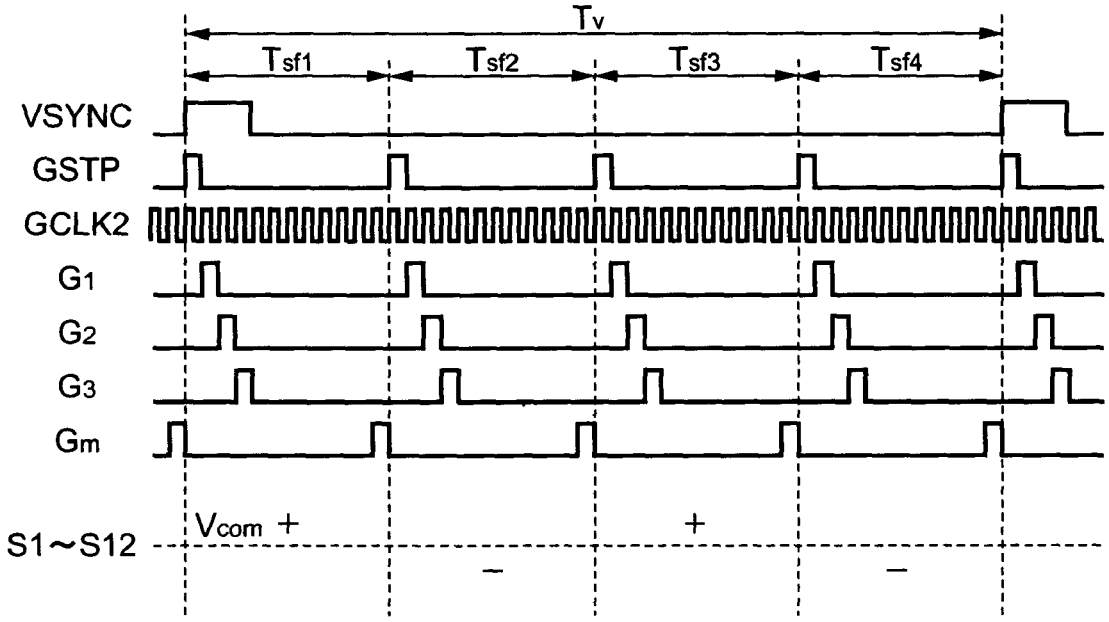
FIG. 10 is a timing chart of the gate driver of the liquid crystal display device, and a timing chart showing polarities of pixel signals for each sub-frame.

The output signal of DFF $48_{12}$ which has been changed from the low level over to the high level to be changed over to the low level is outputted through the inverters $50_1$ and $52_1$, whereby a pulse which is held at the high level for the first horizontal time period of the sub-frame is outputted to the gate line G1 (G1 in FIG. 10).

An output signal of DFF $48_{12}$ which has been changed from the low level over to the high level to be changed from the high level over to the low level, i.e., the start pulse GSTP which has been captured in DFF$48_{12}$ to be outputted is captured in DFF$48_{21}$ with the first vertical clock pulse GCK1 to be outputted. Then, the outputted pulse is captured in DFF$48_{22}$ with the second vertical clock pulse GCK2 to be outputted.

Similar to the process for outputting the pulse which is held at the high level for a first horizontal time period from DFF$48_{12}$ to the gate line G1 through the inverters $50_1$, and $52_1$, the pulse outputted from DFF$48_{22}$ is outputted in the form of a pulse which is held at the high level for a second horizontal time period (G2 in FIG. 10) to the gate line G2 through the inverters $50_2$ and $52_2$.

Hereinbelow, similarly, a pulse outputted from DFF$48_{i2}$ (i in this case is one of 3, 4, . . . , m) is outputted in the form of a pulse which is held at the high level for an i-th horizontal time period to the gate line G1 through the inverters $50_i$ and $52_i$.

As described above, a first pixel signal within a first horizontal time period of a first sub-frame (its sub-frame time period is $T_{sf1}$ (FIG. 10)), and pixel signals at intervals of 2n/K pixel signals from the pixel signal concerned are successively supplied to the pixel signal line S1, and a second pixel signal within a first horizontal time period of the sub-frame, and pixel signals at intervals of 2n/K pixel signals from the second pixel signal are successively supplied to the pixel signal line S2. Hereinbelow, similarly, ON/OFF control signals $SP_k$ are successively supplied from the scanning circuit 14 of the data driver 14 to the ON/OFF control lines $46_k$, and also a gate pulse G1 is supplied from the gate driver 16 to the gate line G1 for a first horizontal time period in parallel with the operation in which supply of an 1-th pixel signal within a first horizontal time period of the sub-frame and successive supply of pixel signals at intervals of 2n/K pixel signals from an 1-th pixel signal (1 in this case is one of 3, 4, . . . , 12) are simultaneously carried out.

Thus, at the time when the array switch $34_1$ has been turned ON (at the time when the 6 switches constituting the array switch $34_1$ have been simultaneously turned ON) with the first ON/OFF control signal $SP_1$ used to cause the block sequential driving, the first pixel signal to the sixth pixel signal within the first horizontal time period constituting a sub-frame simultaneously supplied through the pixel signal lines S1 to S6, respectively, are simultaneously supplied to the data lines $D_1$ to $D_6$ through these 6 switches, respectively. On the other hand, at the time when array switch $34_1$ has been turned OFF, the above-mentioned first to sixth pixel signals are sampled to the corresponding data lines $D_1$ to $D_6$ to be held in floating capacities of the data lines $D_1$ to $D_6$, respectively.

For a time period from the simultaneous supply of the first to sixth pixel signals to the data lines $D_1$ to $D_6$ to the above-mentioned sampling, the above-mentioned first to sixth pixel signals are continued to be applied to the pixel electrodes from the pixel electrode $26_{11}$ to the pixel electrode $26_{16}$, and to storage capacities from a storage capacity $24_{11}$ to a storage capacity $24_{16}$ through TFTs from TFT$22_{11}$ to TFT$22_{16}$ which have been turned ON by the simultaneous supply of the first to sixth pixel signals, respectively.

Thus, for time periods which do not substantially participate in the display of the corresponding pixels (exhibited by $t_{(k-1)1}$, $t_k$ and the like in FIG. 5), as shown in S1 to S6 of FIG. 9, the first pixel signal to the sixth pixel signal which are applied to the data line $D_1$ to the data line $D_6$, respectively, are the signals which are opposite in polarity to the first pixel signal to the sixth pixel signal each having a positive polarity with respect to the electric potential of the counter electrode 27 of the pixel matrix 12 and inputted to the liquid crystal display device.

Figure 8:
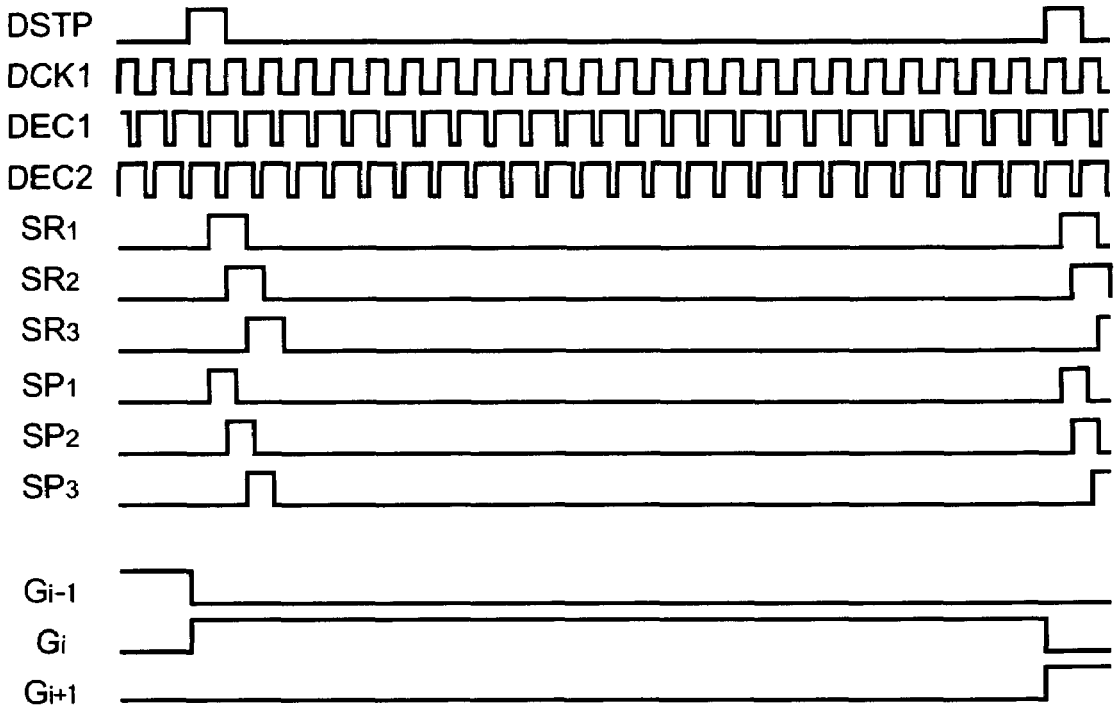
FIG. 8 is a timing chart of the data driver of the liquid crystal display device.

However, for time periods which substantially participate in the display of the corresponding pixels (exhibited by $t_{(k-1)2}$, $t_{k2}$ and the like in FIG. 8), the first pixel signal to the sixth pixel signal which are applied to the data line $D_1$ to the data line $D_6$, respectively, are identical in polarity to the first pixel signal to the sixth pixel signal which are applied to the liquid crystal display device and each of which has the positive polarity with respect to the electric potential of the counter electrode 27 of the pixel matrix 12.

Accordingly, the voltage fluctuation component of each of the first to sixth pixel signals which are held in the floating capacities of the data lines $D_1$ to $D_6$ after the sampling is cancelled by a value determined on the basis of the ratio between the signal time periods of the above-mentioned two kinds of pixel signals every data line of the data lines $D_1$ to $D_6$. As a result, the above-mentioned quantities of voltage fluctuations are reduced.

A similar sampling and holding operation is caused for the data line $D_{6(k-1)+1}$ to the data line $D_{6(k-1)+6}$ by turning ON the array switch $\mathbf{34}_k$ in accordance with the k-th ON/OFF control signals $SP_k$ (k in this case is one of 2, 3, . . . , P) of the block sequential driving.

In this case as well, for time periods which do not substantially participate in the display of the corresponding pixels (exhibited by $t_{(k-1)+1}$, $t_{k1}$ and the like in FIG. 9), the pixel signals which are applied to the data line $D_{6(k-1)+1}$ to the data line $D_{6(k-1)+6}$, respectively, are opposite in polarity to the corresponding pixel signals which are applied to the liquid crystal display device and each of which has the positive polarity with respect to the electric potential of the counter electrode 27 of the pixel matrix 12.

In addition, for time periods which substantially participate in the display of the corresponding pixels (exhibited by $t_{(k-1)2}$, $t_{k2}$ and the like in FIG. 9), the pixel signals which are applied to the data line $D_{6(k-1)+1}$ to the data line $D_{6(k-1)+6}$, respectively, are identical in polarity to the corresponding pixel signals which are inputted to the liquid crystal display device and each of which has the positive polarity with respect to the electric potential of the counter electrode 27 of the pixel matrix 12.

Accordingly, a voltage fluctuation component of each of the 6 pixel signals which are sampled in a manner as described above to be held in the floating capacities of the data line $D_{6(k-1)+1}$ to the data line $D_{6(k-1)+6}$, respectively, is cancelled by a value determined on the basis of the ratio between the signal time periods of the above-mentioned two kinds of pixel signals for every data lines from the data line $D_{6(k-1)+1}$ to the data line $D_{6(k-1)+6}$. As a result, the above-mentioned voltage fluctuation quantity is reduced.

Then, at a time instant of end of the first horizontal time period after the operation for sampling and holding for each block has been completed up to the final block, the corresponding pixel signals which are applied to from the pixel electrodes from the pixel electrode $\mathbf{26}_{11}$ to the pixel electrode $\mathbf{26}_{16}$ to the pixel electrodes from the pixel electrode $\mathbf{26}_{1(6(P-1)+1)}$ to the pixel electrode $\mathbf{26}_{1(6(P-1)+6)}$, and to from the storage capacities from the storage capacity $\mathbf{24}_{11}$ to the storage capacity $\mathbf{24}_{16}$ to the storage capacities from the storage capacity $\mathbf{24}_{1(6(P-1)+1)}$ to the storage capacity $\mathbf{24}_{1(6(P-1)+6)}$, respectively, are sampled in response to a trailing edge of the gate pulse applied to the gate line G1 to be applied and held in the corresponding pixel electrodes and storage capacities, respectively.

The display corresponding to the pixel signals which are applied and held is caused on the corresponding pixels.

That display is continued until the first horizontal time period of a next sub-frame (its sub-frame time period is $T_{sf2}$ (FIG. 7)) has come and then at a time instant of end of the first horizontal time period, the sampling which is the same as that of the foregoing is carried out.

The above-mentioned operation for the first horizontal time period is repeatedly carried out by the number of horizontal time periods constituting a sub-frame.

In addition, with respect to other sub-frames constituting a frame as well, the same operation is repeatedly carried out.

The driving in these sequential sub-frames, in a sub-frame just following a preceding sub-frame, is carried out in the form of the sub-frame inversion driving similar to the conventional frame inversion driving with which the polarity of the whole sub-frame is inverted.

Note that, while a detailed description with respect to each sub-frame inversion driving is omitted here since it is judged to be understood if the description with respect to the above-mentioned sub-frame is referred, for the sake of assistance of understanding thereof, a timing chart thereof is shown in FIG. 10.

As described above, according to this embodiment, in the sub-frame inversion driving using the pixel signals of the positive polarity with respect to the electric potential of the counter electrode constituting the pixel matrix, the pixel signals of 12 phases are divided into 2 blocks; and there is carried out the block sequential driving in which there is repeatedly carried out every block the operation in which for a time period which does not substantially participate in the display of 6 pixel signals within each block, the pixel signals which are opposite in polarity to the pixel signals each having the positive polarity with respect to the electric potential of the counter electrode are applied to the data lines, respectively; for a time period up to the sampling time instant after a lapse of the above-mentioned time period, the pixel signals each having the positive polarity with respect to the electric potential of the counter electrode are applied to the data lines, respectively; and the pixel signals having the positive polarity with respect to the electric potential of the counter electrode are sampled at the sampling time instant to be held in the floating capacities of the corresponding data lines, respectively, whereby the pixel signals which are held in the data lines, respectively, are sampled at a time instant of end of the horizontal time period concerned to be held in the corresponding pixel electrodes and storage capacities, respectively, to thereby carry out the display for the pixels.

As a result, when the pixel signals each having the positive polarity with respect to the electric potential of the counter electrode constituting the pixel matrix are written to the pixels through the data lines, respectively, the fluctuation in the signal voltages on the data lines is arranged to reduce a quantity of voltage fluctuations of all the data lines.

Accordingly, the transverse crosstalk which is caused in the conventional frame inversion driving is greatly reduced.

In addition, as described above, since before the pixel signals are applied to the data lines defined in blocks, respectively, the pixel signals which are opposite in polarity thereto are necessarily applied to the corresponding data lines four times within the horizontal time period, respectively, the same effects as those in the conventional precharge driving are obtained without taking a special pre-charge time period, and hence the horizontal crosstalk is greatly reduced.

In addition, at the time a predetermined time period before a time instant of the sampling of the 6 pixel signals of the preceding block to the corresponding data lines, the 6 pixel signals of the same polarity of a block just following a preceding block are applied to the corresponding data lines, respectively. Thus, it is possible to greatly reduce signals (noises) which burst from the data line belonging to a block just following a preceding block into the data line belonging to the preceding block adjacent to the data line concerned, and hence it is possible to largely suppress the generation of the longitudinal streak nonuniformity.

Moreover, in addition to the above-mentioned effects, since one frame is divided into four sub-frames to drive the pixel matrix, the flicker becomes difficult to detect.

Further, the voltage reduction due to the leakage currents of the pixel TFTs as the primary factor of generation of the flicker is decreased as the frame time period is shortened to be the sub-frame time period. The reduction in decrease of a voltage results in that a level itself of the flicker can be suppressed to a small degree and synergistically, the reduction of the flicker can be attained.

While achieving these effects, an enhancement of an aperture ratio obtained through the frame inversion driving is simultaneously obtained.

On the other hand, if the pixel signals are written to the pixel electrodes once on a frame, respectively, then the writing of the pixel signals moves the liquid crystal molecules to cause capacity changes in the pixel capacities to cause reduction in electric field applied to the liquid crystal layer to thereby reduce the operating speed of the liquid crystal.

However, as described above in an illustrative embodiment, one frame is divided into four sub-frames, and under this condition, the pixel matrix is driven to write the same pixel signal to the same pixel electrode four times. As a result, even if the capacity changes are generated in the pixel capacities, insufficient electric charges are filled up, and hence there is also simultaneously provided an effect in that the strength of the electric field applied to the liquid crystal layer is prevented from being reduced to enhance the operating speed of the liquid crystal.

[Second Embodiment]

Figure 11:
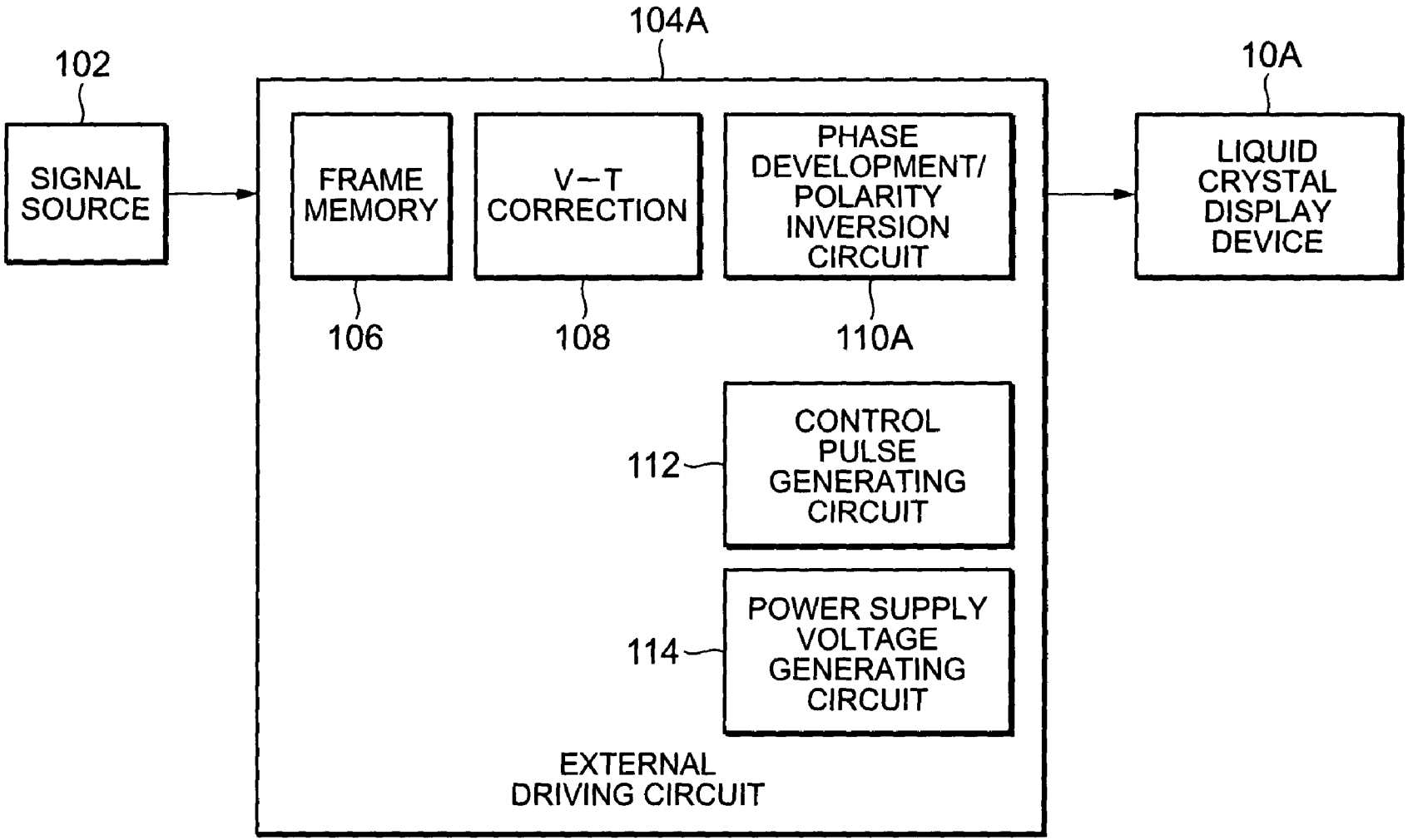
FIG. 11 is a diagram showing an external driving circuit for supplying signals to a liquid crystal display device according to a second embodiment of the present invention.
Figure 12:
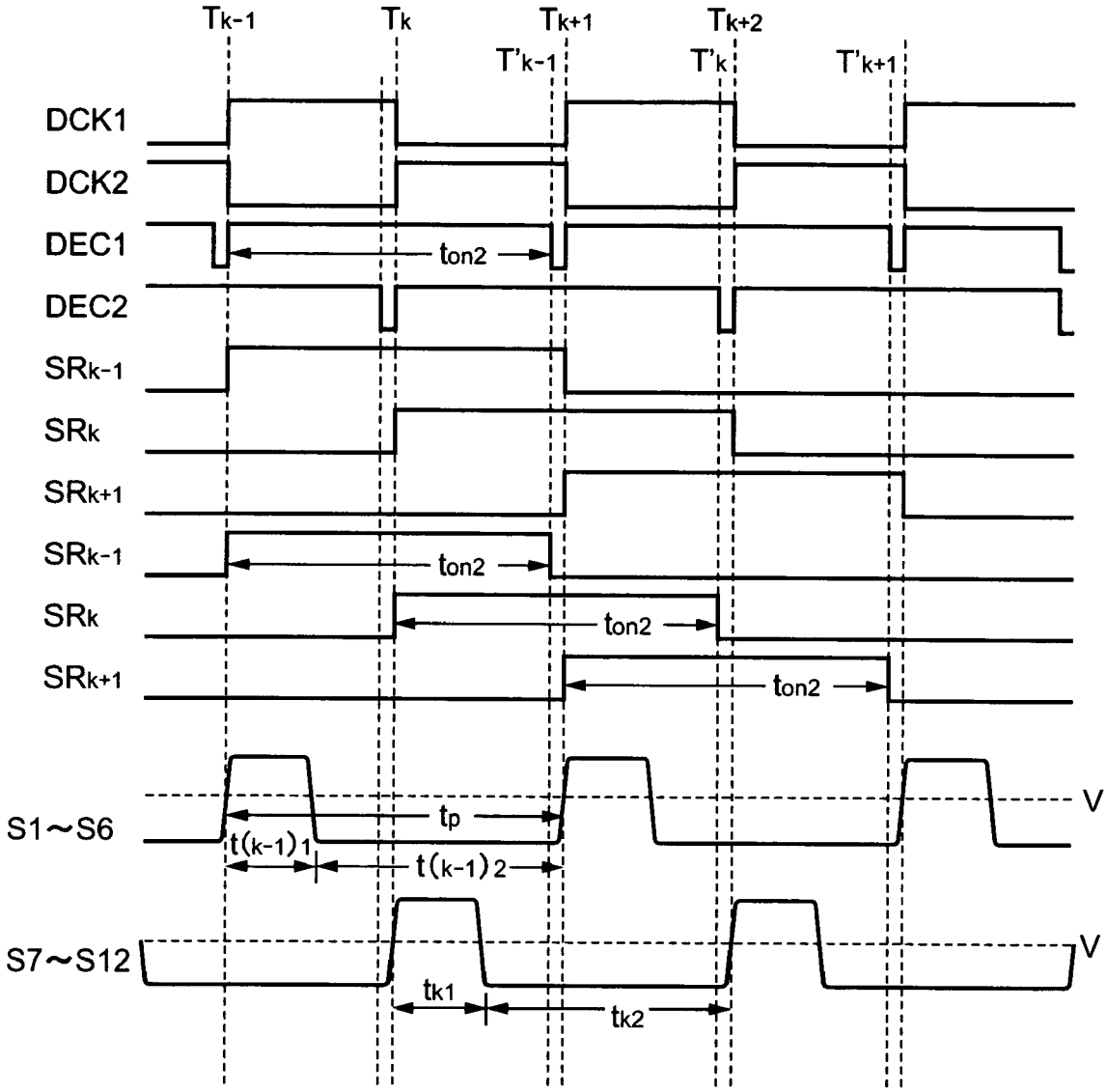
FIG. 12 is a detailed timing chart of the data driver of the liquid crystal display device, and a timing chart with which pixel signals of a negative polarity with respect to an electric potential of a counter electrode are supplied to a pixel matrix.

FIG. 11 is a diagram showing an external driving circuit for supplying signals to a liquid crystal display device according to a second embodiment of the present invention, and FIG. 12 is a detailed timing chart of a data driver of the liquid crystal display device and a timing chart in a sub-frame in which pixel signals each having a negative polarity with respect to an electric potential of a counter electrode of a pixel matrix are written to corresponding pixels within the pixel matrix, respectively.

A point of difference between the structure of this embodiment from that of the first embodiment is that the pixel signals each having a negative polarity with respect to the electric potential of the counter electrode of the pixel matrix are written to the corresponding pixels within the pixel matrix, respectively.

That is, the liquid crystal display device 10A of this embodiment is configured such that in the block sequential driving of the pixel matrix for each sub-frame in which the pixel matrix is subjected to the sub-frame inversion driving, the pixel signals which are to be applied to the data lines, respectively, are made negative in polarity with respect to the electric potential of the counter electrode of the pixel matrix to be applied to the data lines, respectively.

It is the same as that in the first embodiment is that in a phase development/polarity inversion circuit 110A of an external driving circuit 104A, one frame is divided into four sub-frames, the signals of 12 phases are divided into blocks every sub-frame, and each block is time-divided to be outputted.

It is also the same in format of the time-divided signal as in the first embodiment that with respect to the first half 6 phases of each block belonging to one horizontal time period, 6 pixel signals are simultaneously outputted as their signals (in parallel with one another), and next, with respect to the latter half 6 phases, the next 6 pixel signals are simultaneously outputted as their signals.

It is also the same as in the first embodiment that every 6 pixel signals are successively applied as one block to the data lines of the pixel matrix 12 of a liquid crystal display device 10A to be sampled and held, and a fixed switch-ON time period is taken until after the pixel signals are started to be applied to the data lines of a certain one block, the sampling for the block concerned is carried out.

A point of difference from the first embodiment that for the front time period within the switch-ON time period, the above-mentioned 6 pixel signals to be outputted in parallel with one another are outputted as the signals which are opposite in polarity to the pixel signals each having the negative polarity with respect to the electric potential of the counter electrode 27 of the pixel matrix 12, and on the heels thereof, for a time period from a time instant after a lapse of the above-mentioned front time period to end of the above-mentioned switch-ON time, these 6 pixel signals are outputted as the pixel signals of the negative polarity.

The pixel signals of 12 phases having such a signal format are supplied from a phase development/polarity inversion circuit 110A to a liquid crystal display device 10A.

Since a configuration of portions of this embodiment except for the above mentioned configuration is the same as that of the first embodiment, these portions are designated with the same reference numerals as those in FIG. 4 and FIG. 5, and a description thereof is omitted here.

Next, the operation of this embodiment will hereinbelow be described with reference to FIG. 11 and FIG. 12.

The pixel signals of 12 phases which are outputted from the phase development/polarity inversion circuit 110A of the external control circuit 104A to the pixel signal lines S1 to S12 are the same as those on the pixel signal lines S1 to S12 of the first embodiment except that as described above, they are the signals each having the negative polarity with respect to the electric potential of the counter electrode 27 of the pixel matrix 12.

In addition, the operations of the data driver 14 and the gate driver 16 in this embodiment are also the same as those in the first embodiment.

It is also the same as in the first embodiment that in the block sequential driving which is caused by turning ON/OFF the switch array $\mathbf{34}_k$ in accordance with the ON/OFF control signal $SP_k$ outputted from the scanning circuit 32 of the data driver 14, half of the pixel signals of 12 phases supplied through the pixel signal lines S1 to S12, respectively, are successively applied to the 6 data lines $D_{6(k-1)+1}$ to $D_{6(k-1)+6}$ by turn-ON of the switch array $\mathbf{34}_k$ determined on the basis of the block sequential driving and sampled for a time period of turn-OFF to be held in the floating capacities of the data lines $D_{6(k-1)+1}$ to $D_{6(k-1)+6}$, respectively.

In this case as well, for time periods which do not substantially participate in the display of the corresponding pixels (exhibited by $t_{(k-1)1}$, $t_{k1}$ and the like in FIG. 11), the pixel signals applied to the data lines $D_{6(k-1)+1}$ to $D_{6(k-1)+6}$, respectively, are the signals which are opposite in polarity to the pixel signals each having the negative polarity with respect to the electric potential of the counter electrode 27 of the pixel matrix 12.

In addition, for time periods (time periods exhibited by $t_{(k-1)2}$, $t_{k2}$ and the like in FIG. 11) which substantially participate in the display of the corresponding pixels, the pixel signals which are applied to the data lines $D_{6(k-1)+1}$ to $D_{6(k-1)+6}$, respectively, are identical in polarity to the pixel signals each having the negative polarity with respect to the electric potential of the counter electrode 27 of the pixel matrix 12.

Accordingly, the voltage fluctuation component of each of the 6 pixel signals which are held in the floating capacities of the data lines $D_{6(k-1)+1}$ to $D_{6(k-1)+6}$, respectively, after the above-mentioned sampling is cancelled by a value determined on the basis of the ratio between the signal time periods of the above-mentioned two kinds of pixel signals every data line of the data lines $D_{6(k-1)+1}$ to $D_{6(k-1)+6}$. As a result, quantities of voltage fluctuations of the 6 pixel signals which are held in the floating capacities of the data lines $D_{6(k-1)+1}$ to $D_{6(k-1)+6}$ are reduced.

Then, it is also the same as in the first embodiment that even at a time instant of end of any of the horizontal time periods, the block sequential driving turns OFF the pixel TFTs to which the corresponding gate lines are connected at a trailing edge of the corresponding gate pulse, i.e., samples the pixel signals on the data lines connected to drains of the pixel TFTs concerned, respectively, to hold the sampled pixel signals in the corresponding pixel electrodes and storage capacities to submit them to the display until end of a next horizontal time period.

It is also the same as that in the first embodiment that the display is caused every sub-frame of a frame.

The driving in these sequential sub-frames, in the sub-frame just following the preceding sub-frame, is carried out in the form of the sub-frame inversion driving similar to the conventional frame inversion driving in which the polarity of the whole sub-frame is inverted.

As described above, according to this embodiment, in the sub-frame inversion driving in which the pixel signals each having the negative polarity with respect to the electric potential of the counter electrode constituting the pixel matrix are applied, the pixel signals of 12 phases are divided into two blocks; and there is carried out the block sequential driving in which there is repeatedly carried out every block the operation in which for a time period which does not substantially participate in the display of the 6 pixel signals within each block, the pixel signals which are opposite in polarity to the pixel signals each having the negative polarity with respect to the electric potential of the counter electrode are applied to the data lines, respectively; the pixel signals each having the negative polarity with respect to the electric potential of the counter electrode are continued to be applied to the data lines, respectively, until a time instant of the sampling after an elapse of the above-mentioned time period; and the pixel signals each having the negative polarity with respect to the electric potential of the counter electrode are sampled at a time instant of the sampling to be held in the floating capacities of the corresponding data lines, whereby the pixel signals held in the data lines, respectively, are sampled at a time instant of end of the horizontal time period concerned to be held in the corresponding pixel electrodes and storage capacities to thereby cause the display on the pixels.

As a result, when the pixel signals each having the negative polarity with respect to the electric potential of the counter electrode constituting the pixel matrix are written to the pixels through the data lines, respectively, the fluctuation of the signal voltages on the data lines is averaged to reduce quantities of voltage fluctuations of all the data lines.

Accordingly, the transverse crosstalk which is caused in the conventional frame inversion driving is greatly reduced.

In addition, as described above, since prior to the application of the pixel signals to the data lines defined in blocks, the pixel signals of the polarity opposite thereto are applied four times for a horizontal time period, the same effects as those in the conventional precharge driving are provided without taking a special precharge time period, and hence the longitudinal crosstalk is greatly reduced.

In addition, before a time instant of the sampling of the 6 pixel signals of the preceding block to the data lines by a predetermined time period, the 6 pixel signals of the same polarity of a block just following a preceding block are applied to the data lines, respectively. Thus, it is possible to greatly reduce signals (noises) which burst from the data line belonging to a block just following a preceding block into the data line belonging to the preceding block adjacent to the data line concerned, and hence it is possible to largely suppress the generation of the longitudinal streak nonuniformity.

In addition, with respect to reduction of flicker, enhancement of an aperture ratio, and improvement in operating speed of liquid crystal, the same effects as those of the first embodiment are provided.

[Third Embodiment]

A point of difference of the structure of this embodiment from that of the first embodiment is that the block sequential driving of a pixel matrix for each sub-frame with which the pixel matrix is subjected to the sub-frame inversion driving is carried out every three blocks.

Figure 14:
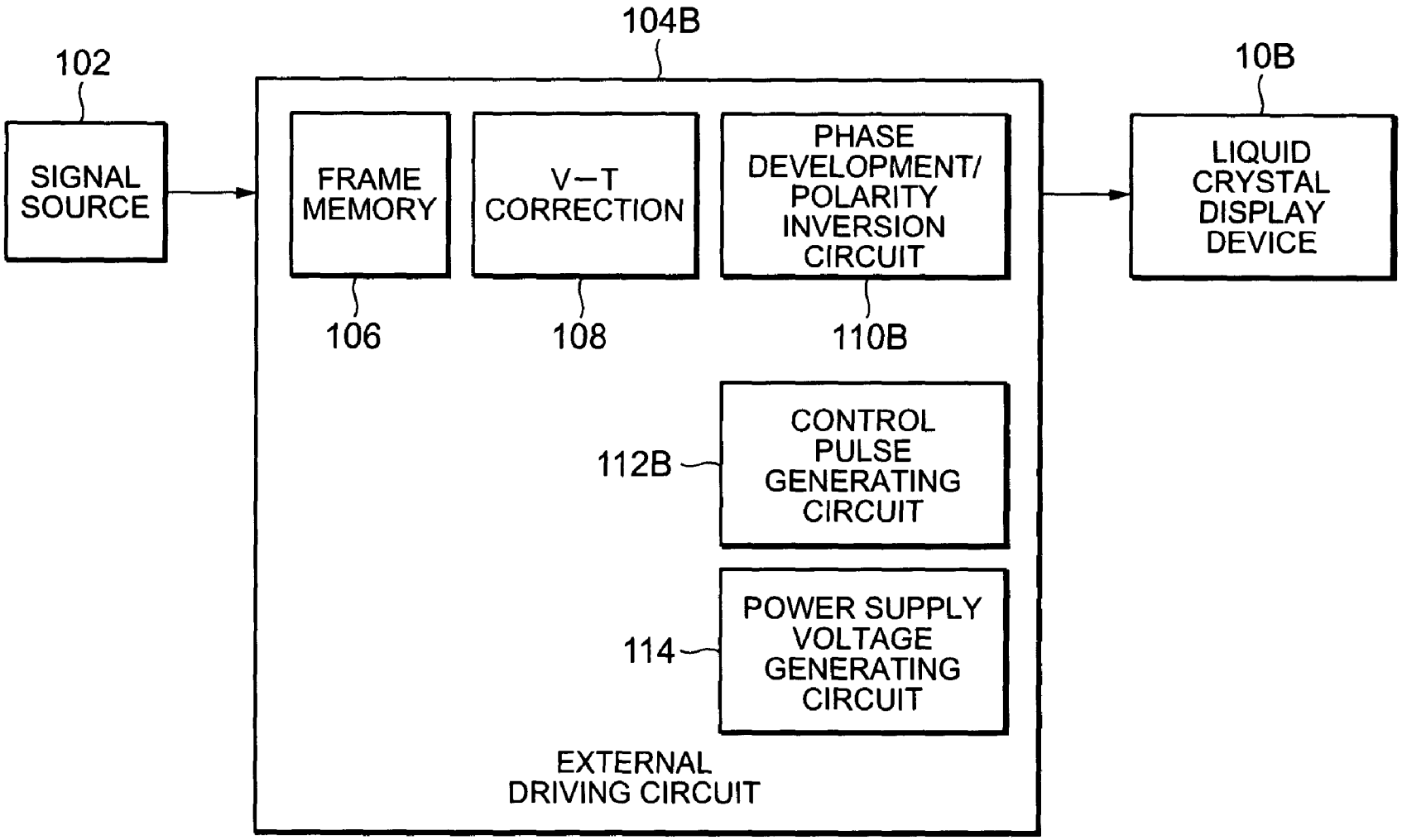
FIG. 14 is a diagram showing an external driving circuit for supplying signals to the liquid crystal display device.

As shown in FIG. 14, a liquid crystal display device 10B of this embodiment is configured so that pixel signals S1 to S18 of 18 phases are outputted every sub-frame from a phase development/polarity inversion circuit 110B of an external driving circuit 104B; Q (natural number) ON/OFF control signals $SP_1$ to $SP_Q$ are outputted from a scanning circuit 32B of a data driver 14B; and every block of three blocks constituting the pixel signals S1 to S18 of 18 phases, the pixel signals of the block concerned are sampled to corresponding data lines of the pixel matrix 12 through switches of the switch array which are turned ON in accordance with the corresponding ON/OFF control signals $SP_1$ to $SP_Q$ to submit the sampled pixel signals to the display on the corresponding pixels, respectively.

In the phase development/polarity inversion circuit 110B, similar to the first embodiment, one frame is divided into four sub-frames; every sub-frame, every 6 phases of 18 phases is made a block for the pixel signals of the sub-frame concerned; and the pixel signals of each block are outputted in accordance with the time division format.

The format of signals which are time-divided in the phase development/polarity inversion circuit 110B is the signal format in which 6 pixel signals distributed to the phases of the first block of 18 phases are simultaneously outputted (in parallel with one another). Next, 6 pixel signals distributed to the phases of the second block are simultaneously outputted. Next, 6 pixel signals distributed to the phases of the third block are simultaneously outputted. Pixel signals (18 pixel signals) distributed to the phases of 18 phases following the above-mentioned blocks are successively, simultaneously outputted; and such output is successively continued up to the final pixel signal of the horizontal time period.

Note that, the above-mentioned "next" means a relationship in which at a time instant after a lapse of a half time period of a period of the third horizontal clock pulse DCK3 (which will be described later) from a time instant of period start of a signal time period $t_Q$ of the 6 pixel signals which are contained in the sequential block and are simultaneously outputted, the 6 pixel signals which are contained in the block just following the block concerned and are to be simultaneously outputted are started to be outputted.

Every 6-pixel signals will be successively written as one block to the pixel matrix 12 of the liquid crystal display device 10B. Then, for a time period from start of application of 6 pixel signals of a certain one block to the corresponding data lines up to sampling of the 6 pixel signals of the block concerned to the corresponding data lines, fixed switch-ON time $t_{on3}$ is taken (as will be described later).

For the front time period within the switch-ON time $t_{on3}$, the above-mentioned 6 pixel signals to be outputted in parallel with one another are outputted as the signals which are opposite in polarity to the pixel signals each having the positive polarity with respect to the electric potential of the counter electrode 27 of the pixel matrix 12, while for a time period from a time instant when the above-mentioned front time has elapsed up to end of the above-mentioned switch-ON time $t_{on3}$, they are outputted as the above-mentioned pixel signals of the positive polarity.

The pixel signals of 18 phases having such a signal format are supplied from the phase development/polarity inversion circuit 10B to the liquid crystal display device 10B.

In response to a horizontal synchronous signal VSYNC for video signals, a start pulse DSTP for a horizontal time period, a third clock pulse (called a third horizontal clock pulse) DCK3 and a fourth clock pulse (called a fourth horizontal clock pulse) DCK4 which are used to generate an ON/OFF control signal, and a third decode pulse (called a third horizontal decode pulse) DEC3, a fourth decode pulse (called a fourth horizontal decode pulse) DEC4 and a fifth decode pulse (called a fifth horizontal decode pulse) DEC5 which are used to generate an ON/OFF control signal are generated from the control pulse generating circuit 112B. Also, in response to a vertical synchronous signal VSYNC for video signals, a start pulse GSTP for a vertical time period, and a first clock pulse (called a first vertical clock pulse) GCK1 and a second clock pulse (called a second vertical clock pulse) GCK2 which are used to generate a gate pulse are generated from the control pulse generating circuit 112B. These pulse signals are all supplied to the liquid crystal display device 10B.

The third horizontal clock pulse DCK3 is the pulse having a period of $2T_H/Q+2$ ($T_H$ is a time period of a horizontal time period). The fourth horizontal clock pulse DCK4 is the pulse which is generated by inverting the third horizontal clock pulse DCK3.

In addition, the third horizontal decode pulse DEC3 has a period which is obtained by adding a period of the third horizontal clock pulse DCK3 and a half period of that period to each other, and its leading edge is identical to a leading edge of the third horizontal clock pulse DCK3. Then, when a time period when the third horizontal decode pulse DEC3 rises to be held at the high level is determined as the above-mentioned switch-ON time $t_{on3}$ (in FIG. 6, time instants of its start are $T_{r-1}$, $T_r$, $T_{r+1}$ and the like, and time instants of its end are $T'_{r-1}$, $T'_r$, $T'_{r+1}$ and the like), the third horizontal decode pulse DEC3 is the pulse which is held at the low level for a time period $t_c$ from a time instant of end of the switch-ON time $t_{on3}$ up to a time instant of end of the period of the third horizontal clock pulse DCK3.

The fourth horizontal decode pulse DEC4 has a period which is obtained by adding a period of the fourth horizontal clock pulse DEC4 and a half period of that period to each other, and its leading edge is identical to a leading edge of the fourth horizontal clock pulse DCK4. Also, when a time period when the fourth horizontal decode pulse DEC4 rises to be held at the high level is determined as the above-mentioned switch-ON time $t_{on3}$, the fourth horizontal decode pulse DEC4 is held at the low level for a time period from a time instant of end of the switch-ON time $t_{on3}$ to a time instant of end of the period of the fourth horizontal clock pulse DCK4.

The fifth horizontal decode pulse DEC5 has a period which is obtained by adding a period of the third horizontal clock pulse DCK3 and a half period of that period to each other, and its leading edge is identical to a leading edge of a third horizontal clock pulse DCK3 next to the third horizontal clock pulse DCK3 regulating a leading edge of the third decode pulse DEC3. Also, when a time period when the fifth horizontal decode pulse DEC5 rises to be held at the high level is determined as the above-mentioned switch-ON time $t_{on3}$, the fifth horizontal decode pulse DEC5 is held at the low level for a time period from a time instant of end of the switch-ON time $t_{on3}$ up to a time instant of end of the period of the above-mentioned next third horizontal clock pulse DCK3.

The first vertical clock pulse GCK1 and the second vertical clock pulse GCK2 are generated similarly to the first embodiment.

The data driver 14B includes a scanning circuit 32B for outputting an ON/OFF control signal $SP_r$ every 6 data lines (corresponding to the above-mentioned block) $B_{(r-1)+1}$ (r is one of 1, 2, . . . , Q, Q is the number of blocks and 1 is one of 1, 2, . . . , 6), and a switch array 34B having Q switch arrays $\mathbf{34}_r$ each adapted to simultaneously turn ON/OFF 6 switches in accordance with the ON/OFF control signal $SP_r$.

Figure 13:
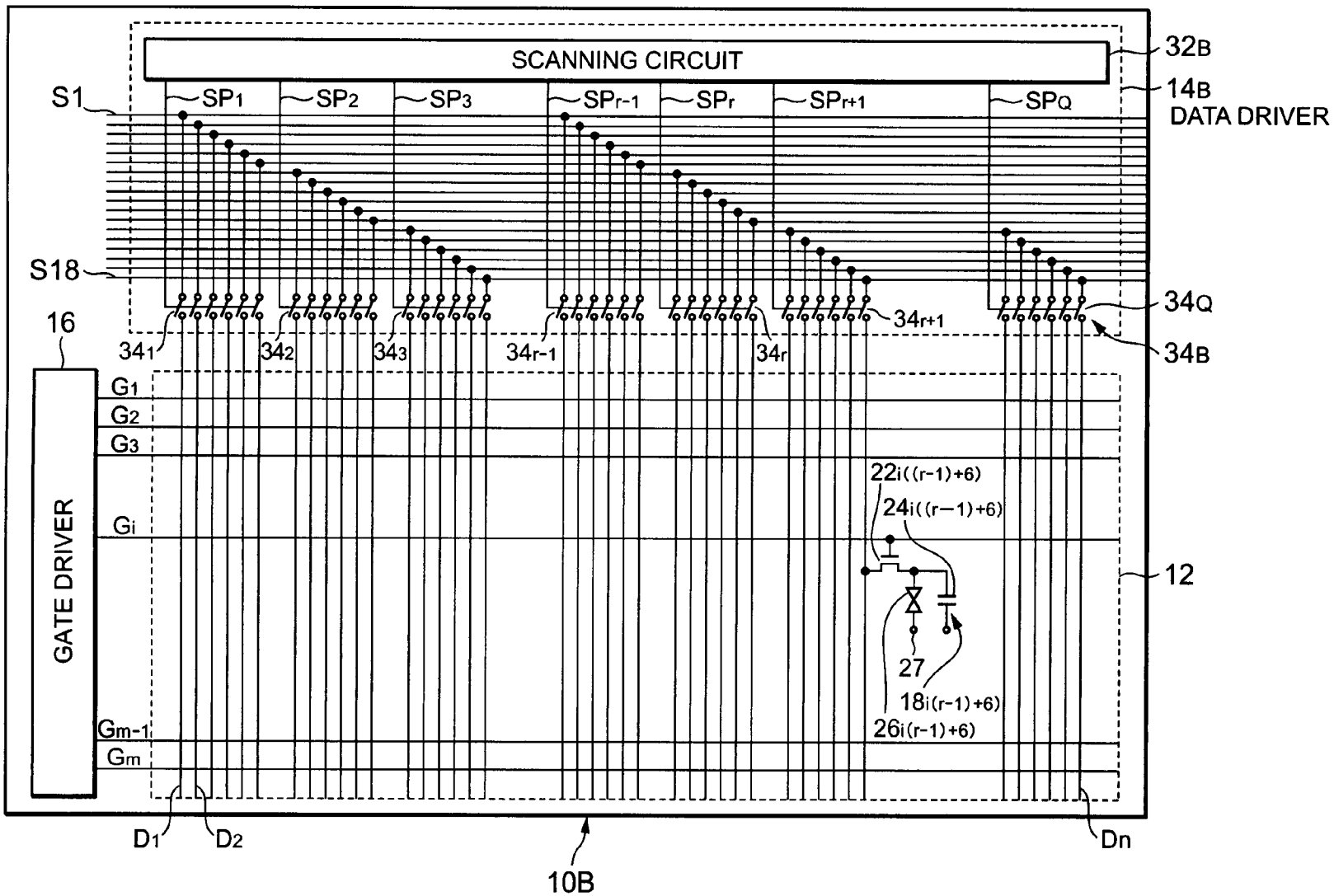
FIG. 13 is a diagram showing a configuration of a liquid crystal display device according to a third embodiment of the present invention.

As shown in FIG. 13, the pixel signal lines S1 to S6 of the 18 pixel signal lines S1 to S18 are connected to input terminals of the first switch array $\mathbf{34}_1$ and the 6 switches of each of the switch arrays arranged at intervals of three switch arrays from the first switch array $\mathbf{34}_1$; the pixel signal lines S7 to S12 of the 18 pixel signal lines S1 to S18 are connected to input terminals of the second switch array $\mathbf{34}_2$ and the 6 switches of each of the switch arrays arranged at intervals of three switch arrays from the second switch array $\mathbf{34}_2$; and the pixel signal lines S13 to S18 of the 18 pixel signal lines S1 to S18 are connected to input terminals of the third switch array $\mathbf{34}_3$ and the 6 switches of each of the switch arrays arranged at intervals of three switch arrays from the third switch array $\mathbf{34}_3$.

Then, output terminals of the first switch array $\mathbf{34}_1$ and the 6 switches of each of the switch arrays arranged every three switch arrays from the first switch array $\mathbf{34}_1$ are connected to the 6 data lines of the first block and the 6 data lines belonging to every third block from the first block; output terminals of the second switch array $\mathbf{34}_2$ and the 6 switches of each of the switch arrays arranged every three switch arrays from the second switch array $\mathbf{34}_2$ are connected to the 6 data lines of the second block and the 6 data lines belonging to every third block from the second block; and output terminals of the third switch array $\mathbf{34}_3$ and the 6 switches of each of the switch arrays arranged every three switch arrays from the third switch array are respectively connected to the 6 data lines of the third block and the 6 data lines belonging to every third block from the third block.

Figure 15:
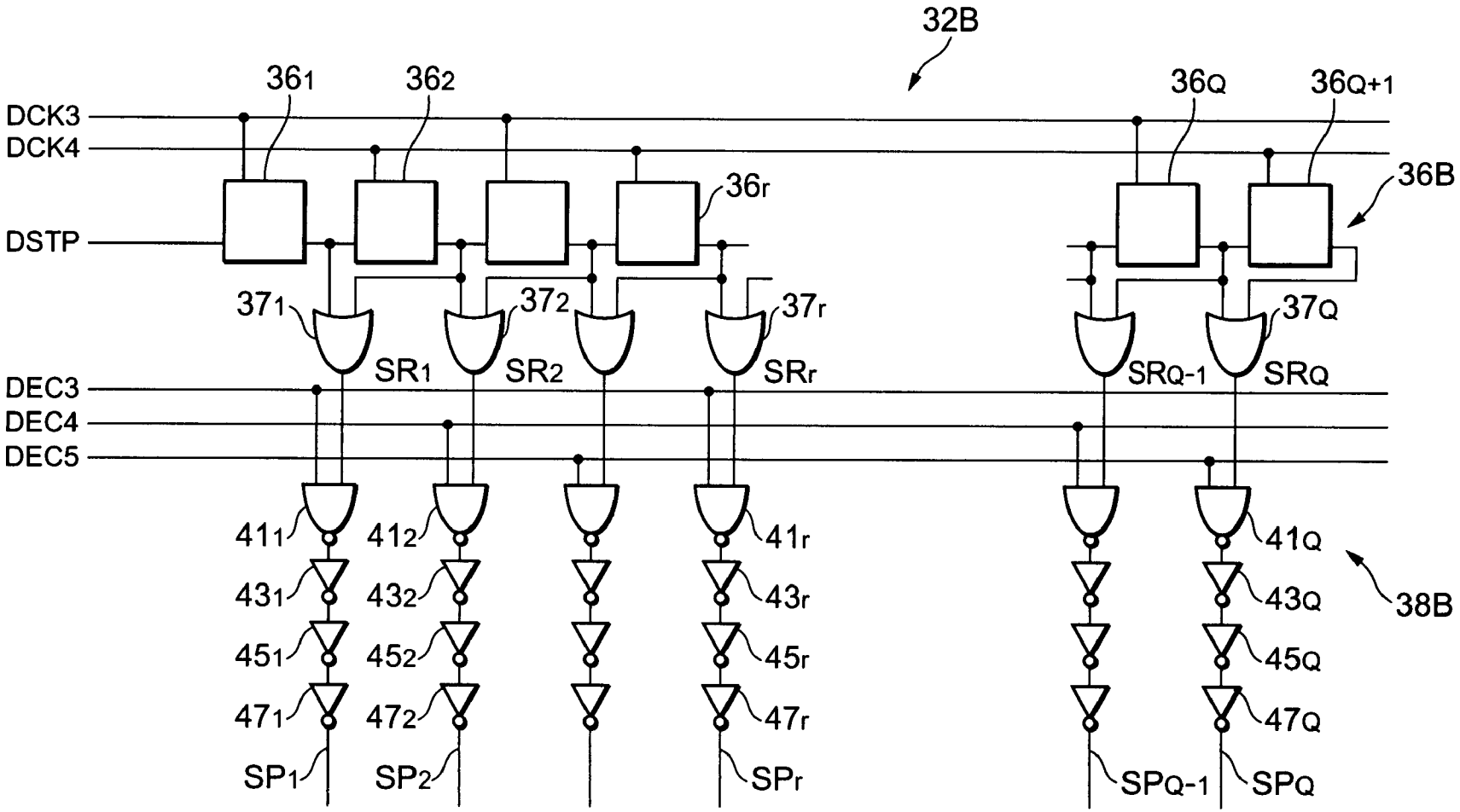
FIG. 15 is a diagram showing a configuration of a data driver of the liquid crystal display device.
Figure 16:
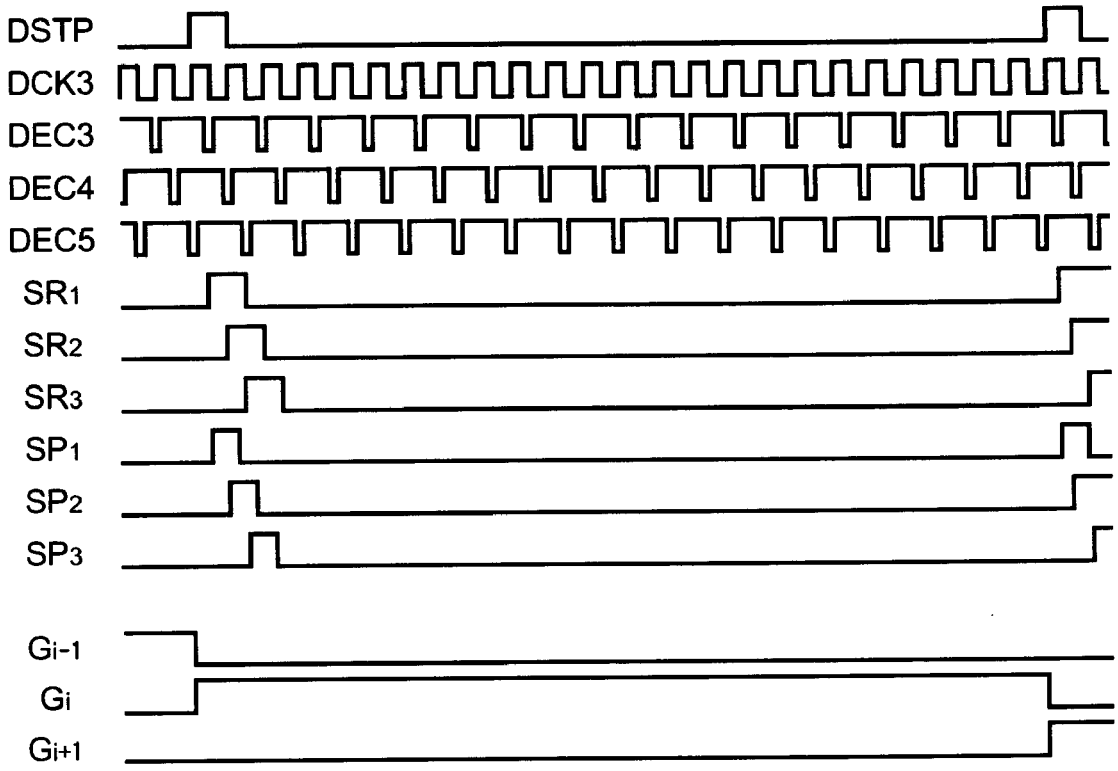
FIG. 16 is a timing chart of the data driver of the liquid crystal display device.

The scanning circuit 32B, as shown in FIG. 15, is made up of a shift register 36B, (Q+1) OR circuits $\mathbf{37}_r$ and a waveform shaping circuit 38B.

The shift register 36B is made up of cascade-connected (Q+1) D type flip-flop circuits (hereinafter referred to as DFFs) $\mathbf{36}_{r+1}$.

Two output terminals of each of the OR circuits $\mathbf{37}_r$ are connected to output terminals of DFF $\mathbf{36}_r$ and DFF $\mathbf{36}_{r+1}$, respectively.

A start pulse DSTP is supplied to a first stage of DFF $\mathbf{36}_1$ of the cascade-connected (Q+1) DFFs $\mathbf{36}_{r+1}$. A period of the start pulse DSTP is a time of a horizontal time period when the corresponding pixel signals within one row of a sub-frame are written to the pixels for one row of the pixel matrix, respectively.

The third horizontal clock pulse DCK3 is supplied to the odd-numbered stages of DFFs of the cascade-connected (Q+1) DFFs $\mathbf{36}_{r+1}$, and the fourth horizontal clock pulse DCK4 is supplied to the even-numbered stages of DFFs thereof.

The waveform shaping circuit 38B, as shown in FIG. 15, is constituted by Q NAND circuits $\mathbf{41}_r$ which are arranged so as to correspond to the Q OR circuits $\mathbf{37}_r$, and Q sets of three stages of inverters $\mathbf{43}_r$, $\mathbf{45}_r$ and $\mathbf{47}_r$ which are connected in series with one another every NAND circuit $\mathbf{41}_r$.

The third horizontal decode pulse DEC3 is supplied from the control pulse generating circuit 112B of the external driving circuit 104B (FIG. 14) to the first NAND circuit $\mathbf{41}_1$, and each of the NAND circuits arranged every three NAND circuits from the first NAND circuit $\mathbf{41}_1$; the fourth horizontal decode pulse DEC4 is supplied from the control pulse generating circuit 112B to the second NAND circuit $\mathbf{41}_2$ and each of the NAND circuits arranged every three NAND circuits from the second NAND circuit $\mathbf{41}_2$; and the fifth horizontal decode pulse DEC5 is supplied from the control pulse generating circuit 112B to the third NAND circuit $\mathbf{41}_3$ and each of the NAND circuits arranged every three NAND circuits from the third NAND circuit $\mathbf{41}_3$.

As described above, a timing of the third horizontal clock pulse DCK3 and a timing of the third horizontal decode pulse DEC3 are set so that a trailing edge of the third horizontal decode pulse DEC3 occurs before a trailing edge within a period of a next third horizontal clock pulse DCK3 by a predetermined time period tc.

Consequently, a time period when the third horizontal decode pulse DEC3 is held at the high level is shorter than a time period which is obtained by adding a period of the third horizontal clock pulse DEC3 to a half period of that period by the predetermined time period $t_c$.

A relationship between the third horizontal clock pulse DCK3 and the third horizontal decode pulse DEC3 is also applied to a relationship between the fourth horizontal clock pulse DCK4 and the fourth horizontal decode pulse DEC4, and a relationship between the third horizontal clock pulse DCK3 and the fifth horizontal decode pulse DEC5.

But, the leading edges of the third horizontal decode DEC3 and the fifth horizontal decode pulse DEC5, and the leading edge of the fourth decode pulse DEC4 are regulated by the leading edge of the third horizontal clock pulse DEC3 and the leading edge of the fourth horizontal clock pulse DEC4, respectively. Hence, the third horizontal decode pulse DEC3, the fourth horizontal decode pulse DEC4 and the fifth horizontal decode pulse DEC5 are shifted in turn from one another by a half period of a period of each of the third horizontal clock pulse DCK3 and the fourth horizontal clock pulse DCK4.

Output terminals of the Q inverters $\mathbf{47}_r$ are connected to control input terminals of the corresponding switch array $\mathbf{35}_r$, respectively.

Since a configuration of portions of this embodiment except for that configuration is the same as that of the first embodiment, these portions are designated with the same reference numerals as those in FIG. 4 and FIG. 5, and the description thereof is omitted here.

Next, the operation of this embodiment will be described hereinbelow with reference to FIGS. 13 to 17.

In this embodiment, in the phase development/polarity inversion circuit 110B, the pixel signals for one frame are divided into a predetermined number of sub-frames, e.g., four sub-frames, and every sub-frame, the pixel signals for three blocks are supplied through the pixel signal lines S1 to S18 in accordance with the above-mentioned time division format in which the pixel signals for three blocks are shifted in turn by a half period of the period of the third horizontal clock pulse or the fourth horizontal clock pulse.

Upon start of the operation of the data driver 14B, DFF$\mathbf{36}_1$, DFF$\mathbf{36}_2$, . . . , DFF$\mathbf{36}_{Q+1}$ are reset, and signals at the low level are outputted from their output terminals, respectively.

The start pulse DSIP, and the third horizontal clock pulse DCK3 and the fourth horizontal clock pulse DCK4 which regulate the above-mentioned blocks, the third horizontal decode pulse DEC3, the fourth horizontal decode pulse DEC4 and the fifth horizontal decode pulse DEC5 are supplied from the control pulse generating circuit 112B to the data driver 14B.

In addition, the start pulse GSTP, the first vertical clock pulse GCK1 and the second vertical clock pulse GLK2 are supplied from the control pulse generating circuit 112B to the gate driver 16.

In the data driver 14B to which the start pulse DSTP, the third horizontal clock pulse DCK3 and the fourth horizontal clock pulse DCK4, the third horizontal decode pulse DEC3, the fourth horizontal decode pulse DEC4 and the fifth horizontal decode pulse DEC5 are supplied, in response to a first leading edge of the third horizontal clock pulse DCK3, the start pulse DSTP is set in DFF$\mathbf{36}_1$. As a result, an output signal SR1 of the OR circuit $\mathbf{37}_1$ undergoes transition from the low level to the high level.

Upon supply of a first leading edge of the fourth horizontal clock pulse DCK4 to DFF$\mathbf{36}_2$, the signal at the high level outputted from DFF$\mathbf{36}_1$ is set in DFF$\mathbf{36}_2$.

Then, since upon supply of a second leading edge of the third horizontal clock pulse DCK3 (forward transition) to DFF$\mathbf{36}_1$, the start pulse DSTP goes the low level so that DFF$\mathbf{36}_1$ is set to the low level, an output signal of DFF$\mathbf{36}_1$ goes to the low level at a time instant of the above-mentioned forward transition. This output signal is left at the low level until a next start pulse DSTP is inputted.

Likewise, with respect to DFF$\mathbf{36}_2$ as well, since upon supply of a second leading edge of the fourth horizontal clock pulse DCK4 (forward transition) to DFF$\mathbf{36}_2$, an output signal of DFF$\mathbf{36}_1$ is set to the low level, an output signal of DFF$\mathbf{36}_2$ goes the low level at a time instant of the above-mentioned forward transition. This output signal is left at the low level until a next start pulse DSTP is inputted to cause the above-mentioned sequential operation.

This is also applied to each of DFFs in and after DFF$\mathbf{36}_3$. But, output signals of DFFs at the preceding stages are supplied to data input terminals of DFFs, respectively.

Figure 17:
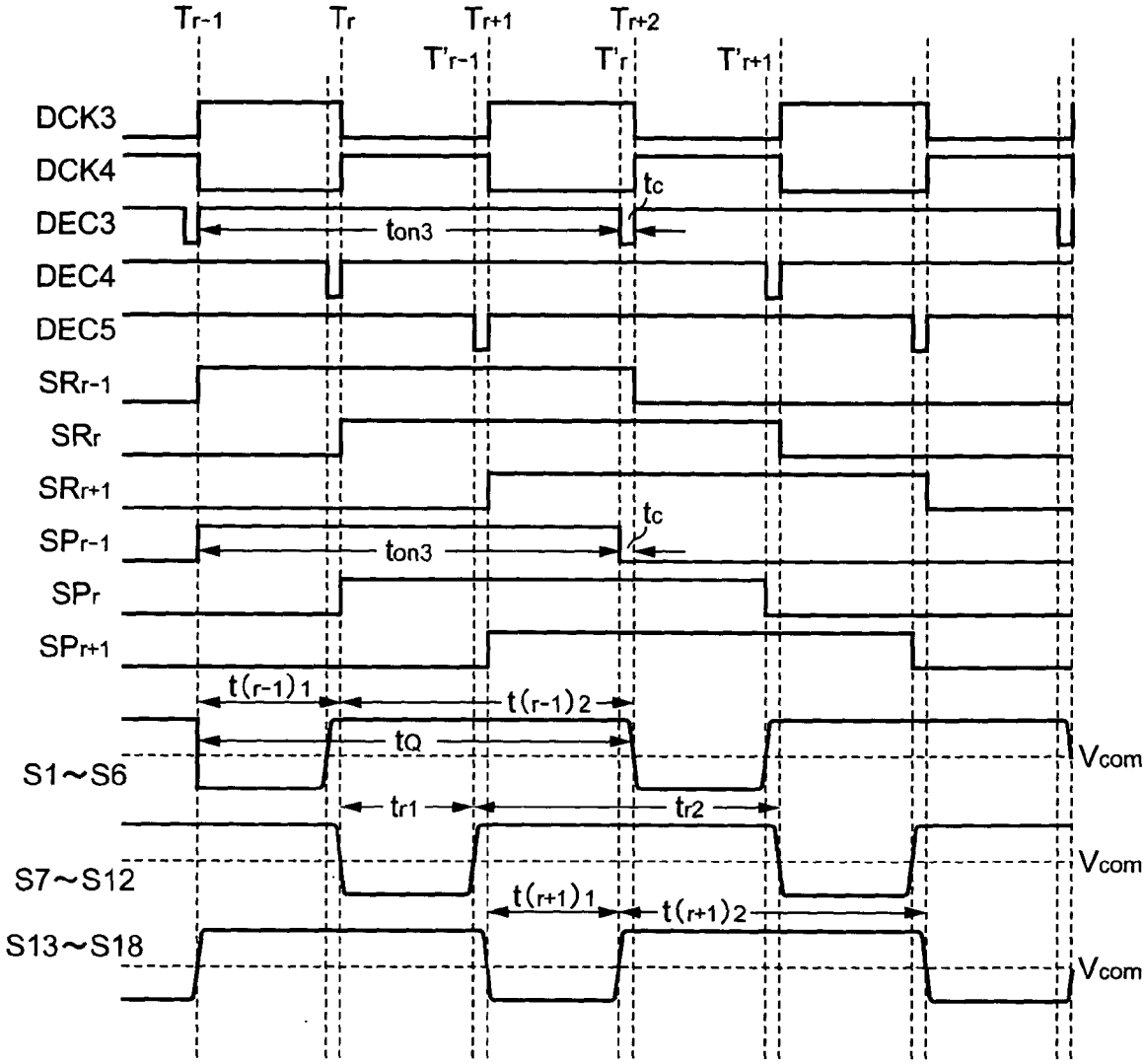
FIG. 17 is a detailed timing chart of the data driver of the liquid crystal display device.

Output signals from $DFF_{r-1}$, $DFF_r$ and $DFF_{r+1}$ of DFFs are shown in the form of $SR_{r-1}$, $SR_r$ and $SR_{r+1}$ of FIG. 17, respectively. $SR_{r-1}$, $SR_r$ and $SR_{r+1}$ of FIG. 17 exhibit output signals of (r−1)-th DFF $\mathbf{36}_{r-1}$, r-th DFF $\mathbf{36}_r$ and (r+1)-th DFF $\mathbf{36}_{r+1}$ *of the cascade-connected* (Q+1) DFFs, respectively.

Logical products between output signals $SR_1$, $SR_4$, . . . outputted from the OR circuit $\mathbf{37}_1$ and the OR circuits arranged every three OR circuits from the OR circuits $\mathbf{37}_1$, and the third horizontal decode pulse DEC3 are carried out in the corresponding NAND circuits $\mathbf{40}_1$, $\mathbf{40}_4$, . . . , respectively; logical products between output signals $SR_2$, $SR_6$, . . . outputted from the OR circuit $\mathbf{37}_2$ and the OR circuits arranged every three OR circuits from the OR circuit $\mathbf{37}_2$, and the fourth horizontal decode pulse DEC4 are carried out in the corresponding NAND circuits $\mathbf{40}_2$, $\mathbf{40}_5$, . . . , respectively; and logical products between output signal $SR_3$, $SR_6$, . . . outputted from the OR circuit $\mathbf{37}_3$ and the OR circuits arranged every three OR circuits from the OR circuit $\mathbf{37}_3$, and the fifth horizontal decode pulse DEC5 are carried out in the corresponding NAND circuits $\mathbf{40}_3$, $\mathbf{40}_6$, . . . , respectively.

In such a manner, the signal which has been outputted from the NAND circuit $\mathbf{40}_r$ after carrying out the logical product concerned therewith in the NAND circuit $\mathbf{40}_r$ is outputted in the form of ON/OFF control signal $SP_r$ from the inverter $\mathbf{47}_r$ through three stages of inverters $\mathbf{43}_r$, $\mathbf{45}_r$ and $\mathbf{47}_r$ dependently connected to the corresponding NAND circuit.

Since the third horizontal clock pulse DCK3 and the third horizontal decode pulse DEC3 are set so as to meet the timing relationship as described above, the leading edges of the first ON/OFF control signal $SP_1$ and the ON/OFF control signals $SP_4$, $SP_7$, . . . generated at intervals of three ON/OFF control signals from the first ON/OFF control signals $SP_1$ of the ON/OFF control signals $SP_1$, $SP_2$, . . . , $SP_Q$, as shown in FIG. 14, agree with the leading edges of the third horizontal clock pulse DCK3, respectively. Then, any of the trailing edges of the third horizontal clock pulse DCK3 occurs before a time instant right after an elapse of a time period obtained by adding a period of the third horizontal clock pulse DCK3 to a half period of that period by the predetermined time period $t_c$.

Since the fourth horizontal clock pulse DCK4 and the fourth horizontal decode pulse DEC4 are set so as to meet the timing relationship as described above, the leading edges of the second ON/OFF control signal $SP_2$ and the ON/OFF control signals $SP_5$, $SP_8$, . . . generated every three ON/OFF control signals from the second ON/OFF control signal $SP_2$ of the ON/OFF control signals $SP_1$, $SP_2$, . . . , $SP_Q$, as shown in FIG. 17, agree with the leading edges of a fourth horizontal clock pulse DCK4. Then, any of the trailing edges of the fourth horizontal clock pulse DCK4 occurs before a time instant right after an elapse of a time period obtained by adding a period of the fourth horizontal clock pulse DCK4 to a half period of that period by the predetermined time period $t_c$.

Since the third horizontal clock pulse DCK3 and the fifth horizontal decode pulse DEC5 are set so as to meet the timing relationship as described above, the leading edges of the third ON/OFF control signal $SP_3$ and the ON/OFF control signals $SP_6$, $SP_9$, . . . generated at intervals of three ON/OFF control signals from the third ON/OFF control signal of the ON/OFF control signals $SP_1$, $SP_2$, . . . , $SP_Q$, as shown in FIG. 17, agree with the leading edges of a third horizontal clock pulse DCK3 next to the third horizontal clock pulse DCK3 regulating the leading edges of the ON/OFF control signals $SP_1$, $SP_4$, $SP_7$, . . . . Then, any of the trailing edges thereof occurs before a time instant right after an elapse of a time period obtained by adding a period of the third horizontal clock pulse DCK3 to a half period of that period from a time instant of start of the period of the above-mentioned next third horizontal clock pulse DCK3 by the predetermined time period tc.

The ON/OFF control signals $SP_1$, $SP_2$, . . . , $SP_Q$ generated in such a manner are supplied to the corresponding switch arrays $\mathbf{34}_1$, $\mathbf{34}_2$, . . . , $\mathbf{34}_Q$ to turn ON/OFF the switches of the switch arrays concerned, respectively.

A time period from turn-ON of the switches of the switch array $\mathbf{34}_1$ to turn-OFF of the switches of the switch array $\mathbf{34}_Q$ corresponds to one horizontal time period of one sub-frame. For the horizontal time period, the gate pulses are supplied from the gate driver 16 to the corresponding gate lines. These gate pulses are illustrated as $G_{i-1}$, $G_i$, and $G_{1+1}$ in FIG. 13 ($G_1$, $G_2$, $G_3$, . . . , $G_m$ in FIG. 10).

As described above, a first pixel signal within a first scanning period of a sub-frame, and every 3n/Q pixel signals from the pixel signal concerned are successively supplied to the pixel signal line S1, and a second pixel signal within the first scanning period of the sub-frame, and every 3n/Q pixel signals from the second pixel signal are successively supplied to the pixel signal line S2. Hereinbelow, similarly, ON/OFF control signals $SP_r$ are successively supplied from the scanning circuit 32B of the data driver 14B to the ON/OFF control lines $\mathbf{46}_r$, and also a gate pulse G1 is supplied to the gate line G1 for a first horizontal time period in parallel with the operation in which supply of an 1-th pixel signal within the first scanning period of the sub-frame and successive supply of every 3n/Q pixel signals from an 1-th pixel signal (1 in this case is one of 3, 4, . . . , 18) are simultaneously carried out.

Thus, at the time when the array switch $\mathbf{34}_1$ has been turned ON (at the time when the 6 switches constituting the array switch $\mathbf{34}_1$ have been simultaneously turned ON) with the first ON/OFF control signal $SP_1$, the first pixel signal to the sixth pixel signal within the first horizontal time period constituting a sub-frame simultaneously supplied through the pixel signal lines S1 to S6, respectively, are simultaneously supplied to the data lines $D_1$ to $D_6$ through these 6 switches, respectively. On the other hand, at the time when array switch $\mathbf{34}_1$ has been turned OFF, the first to sixth pixel signals are sampled to be held in floating capacities of the data lines $D_1$ to $D_6$, respectively.

Thus, for time periods which do not substantially participate in the display of the corresponding pixels (exhibited by $t_{(r-1)1}$, $t_{r1}$ and the like in FIG. 14), as shown in S1 to S6 of FIG. 17, the first pixel signal to the sixth pixel signal which are applied to the six data lines $D_1$ to $D_6$, respectively, are the signals which are opposite in polarity to the first pixel signal to the sixth pixel signal each having a positive polarity with respect to the electric potential of the common electrode 27 of the pixel matrix 12 of the liquid crystal display device 10B.

However, for time periods which substantially participate in the display of the corresponding pixels (exhibited by $t_{(r-1)2}$, $t_{r2}$ and the like in FIG. 14), the first pixel signal to the sixth pixel signal which are applied to the six data lines $D_1$ to $D_6$, respectively, are identical in polarity to the first pixel signal to the sixth pixel signal which are applied to the liquid crystal display device 10B each having the positive polarity with respect to the electric potential of the common electrode 27 of the pixel matrix 12.

Consequently, the voltage fluctuation component of each of the first to sixth pixel signals which are held in the floating capacities of the data lines $D_1$ to $D_6$ after the sampling is cancelled by a value determined on the basis of the ratio between the signal time periods of the above-mentioned two kinds of pixel signals every data line of the data lines $D_1$ to $D_6$. As a result, quantities of voltage fluctuations of the first to sixth signals are reduced.

Then, the first to sixth pixel signals are respectively applied to the pixel electrodes from the pixel electrode $\mathbf{26}_{11}$ to the pixel electrode $\mathbf{26}_{16}$, and to the storage capacities from the storage capacity $\mathbf{24}_{11}$ to the storage capacity $\mathbf{24}_{16}$ through TFTs from TFT $\mathbf{22}_{11}$ to TFT$\mathbf{22}_{16}$ which are turned ON concurrently with turn-ON of the array switch $\mathbf{34}_1$. Then, the first to sixth pixel signals which are held in the floating capacities of the data lines $D_1$ to $D_6$ by the above-mentioned sampling continue to be applied to the corresponding pixel electrodes $\mathbf{26}_{11}$ to $\mathbf{26}_{16}$ and to the corresponding storage capacities $\mathbf{24}_{11}$ to $\mathbf{24}_{16}$ until the trailing edge of the gate pulse G1 occurs.

A similar sampling and holding operation is caused for the data line $D_{6(r-1)+1}$ to the data line $D_{6(r-1)+6}$ by turning ON the array switch $\mathbf{34}_r$ in accordance with the r-th ON/OFF control signal $P_r$ (r in this case is one of 2, 3, . . . , P) of the block sequential driving within the first horizontal time period.

In this case as well, for time periods (time periods exhibited by $t_{(r-1)1}$, $t_{r1}$ and the like in FIG. 14) which do not substantially participate in the display for the corresponding pixels, the pixel signals which are applied to the data lines $D_{6(r-1)+1}$ to $D_{6(r-1)+6}$, respectively, are the signals which are opposite in polarity to the corresponding pixel signals each having the positive polarity with respect to the electric potential of the common electrode 27 of the pixel matrix 12 of the liquid crystal display device 10B.

In addition, for time periods (time periods exhibited by $t_{(r-1)2}$, $t_{r2}$ and the like in FIG. 17) which substantially participate in the display for the corresponding pixels, the pixel signals which are applied to the data lines $D_{6(r-1)+1}$ to $D_{6(r-1)+6}$, respectively, are identical in polarity to the corresponding pixel signals each having the positive polarity with respect to the electric potential of the common electrode 27 of the pixel matrix 12 of the liquid crystal display device 10B.

Consequently, the voltage fluctuation component of each of the 6 pixel signals which are held in the floating capacities of the data lines $D_{6(r-1)+1}$ to $D_{6(r-1)+6}$ by the above-mentioned sampling is cancelled by a value determined on the basis of the ratio between the signal time periods of the above-mentioned two kinds of pixel signals every data line of the data lines $D_{6(r-1)+1}$ to $D_{6(r-1)+6}$. As a result, quantities of voltage fluctuations of the 6 pixel signals which are held in the floating capacities of the data lines $D_{6(r-1)+1}$ to $D_{6(r-1)+6}$, respectively, are reduced.

Then, at a time instant of end of the first horizontal time period after the operation for sampling and holding for each block has been completed up to the final block, the corresponding pixel signals which are applied to from the pixel electrodes from the pixel electrode $\mathbf{26}_{11}$ to the pixel electrode $\mathbf{26}_{16}$ to the pixel electrodes from the pixel electrode $\mathbf{26}_{1(6(r-1)+1)}$ to the pixel electrode $\mathbf{26}_{16(r-1)+6)}$, and to from the storage capacities from the storage capacity $\mathbf{24}_{11}$ to the storage capacity $\mathbf{24}_{16}$ to the storage capacities from the storage capacity $\mathbf{24}_{1(6(Q-1)+1)}$ to the storage capacity $\mathbf{24}_{1(6(Q-1)+6)}$, respectively, are sampled in response to a trailing edge of the gate pulse applied to the gate line G1 to be held in the corresponding pixel electrodes and storage capacities, respectively.

The display corresponding to the pixel signals which are held is caused on the corresponding pixels.

Such holding and display is continued until the first horizontal time period of a next sub-frame has come and then at a time instant of end thereof, the sampling which is the same as that of the foregoing is carried out.

The above-mentioned operation for the first horizontal time period is repeatedly carried out the number of times equal to the number of horizontal time periods constituting a sub-frame.

In addition, with respect to other sub-frames constituting a frame as well, the same operation is repeatedly carried out.

The driving in these sequential sub-frames, in a sub-frame just following a preceding sub-frame, is carried out in the form of the sub-frame inversion driving similar to the conventional frame inversion driving with which the polarity of the whole sub-frame is inverted.

As described above, according to this embodiment, in the sub-frame inversion driving applying the pixel signals of the positive polarity with respect to the electric potential of the counter electrode constituting the pixel matrix, there is carried out the block sequential driving in which there is repeatedly carried out every block the operation in which: the pixel signals of 18 phases are divided into 3 blocks; for a time period which does not substantially participate in the display of 6 pixel signals within each block, the pixel signals which are opposite in polarity to the pixel signals each having the positive polarity with respect to the electric potential of the counter electrode are applied to the data lines, respectively; for a time period up to the sampling time instant after a lapse of the above-mentioned time period, the pixel signals each having the positive polarity with respect to the electric potential of the counter electrode are applied to the data lines, respectively; and the pixel signals each having the positive polarity with respect to the electric potential of the counter electrode are sampled at the sampling time instant to be held in the floating capacities of the corresponding data lines, respectively, whereby the pixel signals which are held in the data lines, respectively, are sampled at a time instant of end of the horizontal time period concerned to be held in the corresponding pixel electrodes and storage capacities, respectively, to thereby carry out the display for the pixels.

As a result, when the pixel signals each having the positive polarity with respect to the electric potential of the counter electrode constituting the pixel matrix are written to the pixels through the data lines, respectively, the fluctuation in the signal voltages on the data lines is averaged to reduce quantities of voltage fluctuations of all the data lines.

Consequently, the transverse crosstalk which is caused in the conventional frame inversion driving is greatly reduced.

In addition, as described above, since prior to the application of the pixel signals to the data lines defined in blocks, respectively, the pixel signals which are opposite in polarity thereto are necessarily applied four times within the horizontal time period, respectively, the same effects as those in the conventional precharge driving are obtained without taking a special precharge time period, and hence the horizontal crosstalk is greatly reduced.

In addition, before a time instant of the sampling of the 6 pixel signals of the preceding block to the corresponding data lines by a predetermined time period, the 6 pixel signals of the same polarity of a block just following the preceding block are applied to the corresponding data lines, respectively. Thus, it is possible to greatly reduce signals (noises) which burst from the data line belonging to a block just following a preceding block into the data line belonging to the preceding block adjacent to the data line concerned, and hence it is possible to largely suppress the generation of the longitudinal streak nonuniformity.

Moreover, in addition to the acceptance of the those effects, since one frame is divided into four sub-frames in order to drive the pixel matrix, the flicker becomes difficult to be detected.

In addition, the voltage reduction due to the leakage currents of the pixel TFTs as a factor of generation of the flicker is decreased as the frame time period is shortened to be the sub-frame time period. The decrease in the voltage reduction results in that a level itself of the flicker can be suppressed to a small degree and synergistically, the reduction of the flicker can be attained.

While achieving those effects, the enhancement of an aperture ratio obtained through the frame inversion driving can be simultaneously obtained.

On the other hand, if the pixel signals are written to the pixel electrodes once a frame, respectively, then the writing of the pixel signals moves the liquid crystal molecules to cause the capacity changes in the pixel capacities to cause reduction in the strength of electric field applied to the liquid crystal layer to thereby reduce the operating speed of the liquid crystal.

However, as described above, one frame is divided into four sub-frames and under this condition, the pixel matrix is driven to write the same pixel signal to the same pixel electrode four times. Consequently, even if the capacity changes are generated in the pixel capacities, the insufficient electric charges are filled up, and hence there is also simultaneously obtained the effect in that the strength of the electric field applied to the liquid crystal layer is prevented from being reduced to enhance the operating speed of the liquid crystal.

[Fourth Embodiment]

Figure 18:
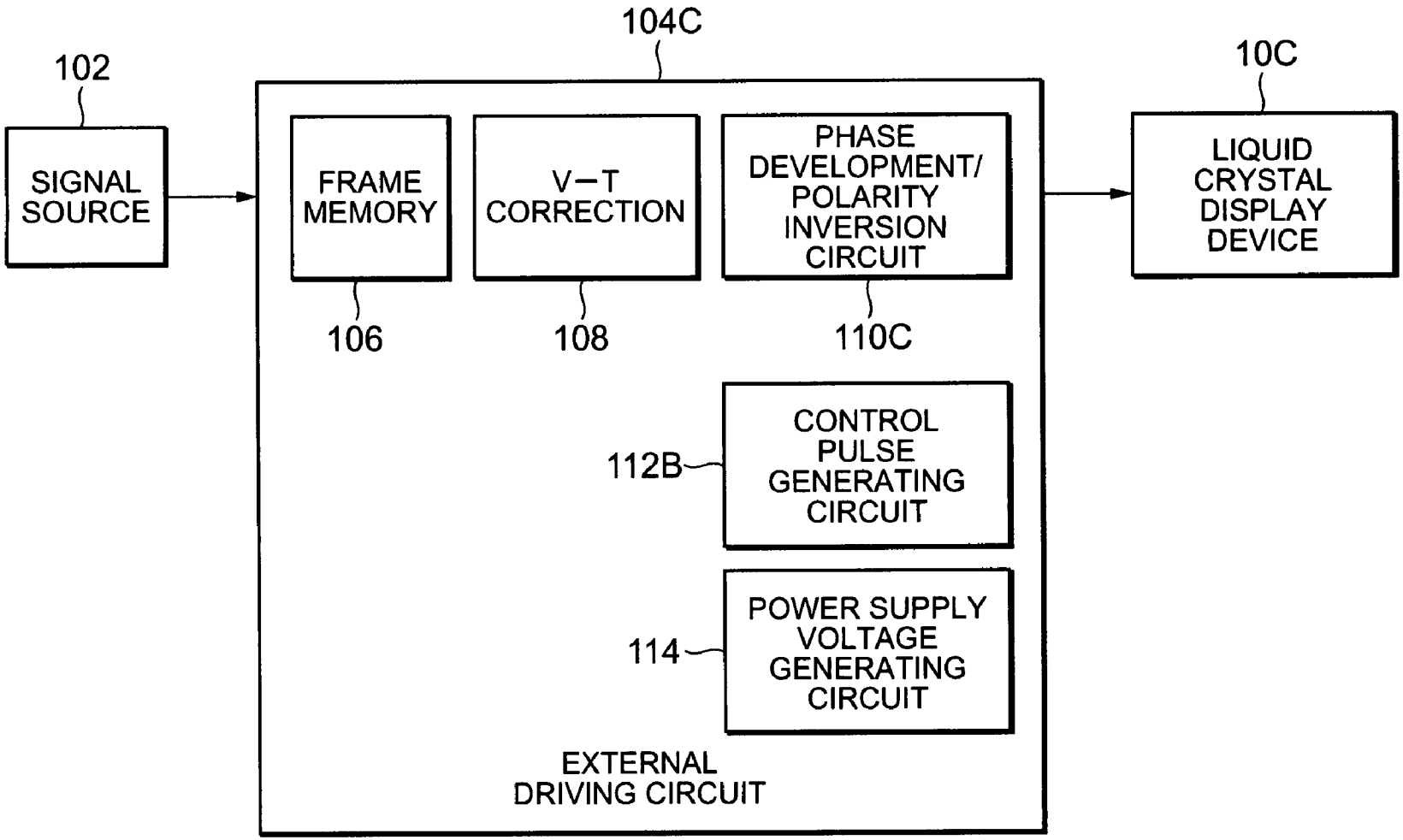
FIG. 18 is a diagram showing an external driving circuit for supplying signals to a liquid crystal display device according to a fourth embodiment of the present invention.
Figure 19:
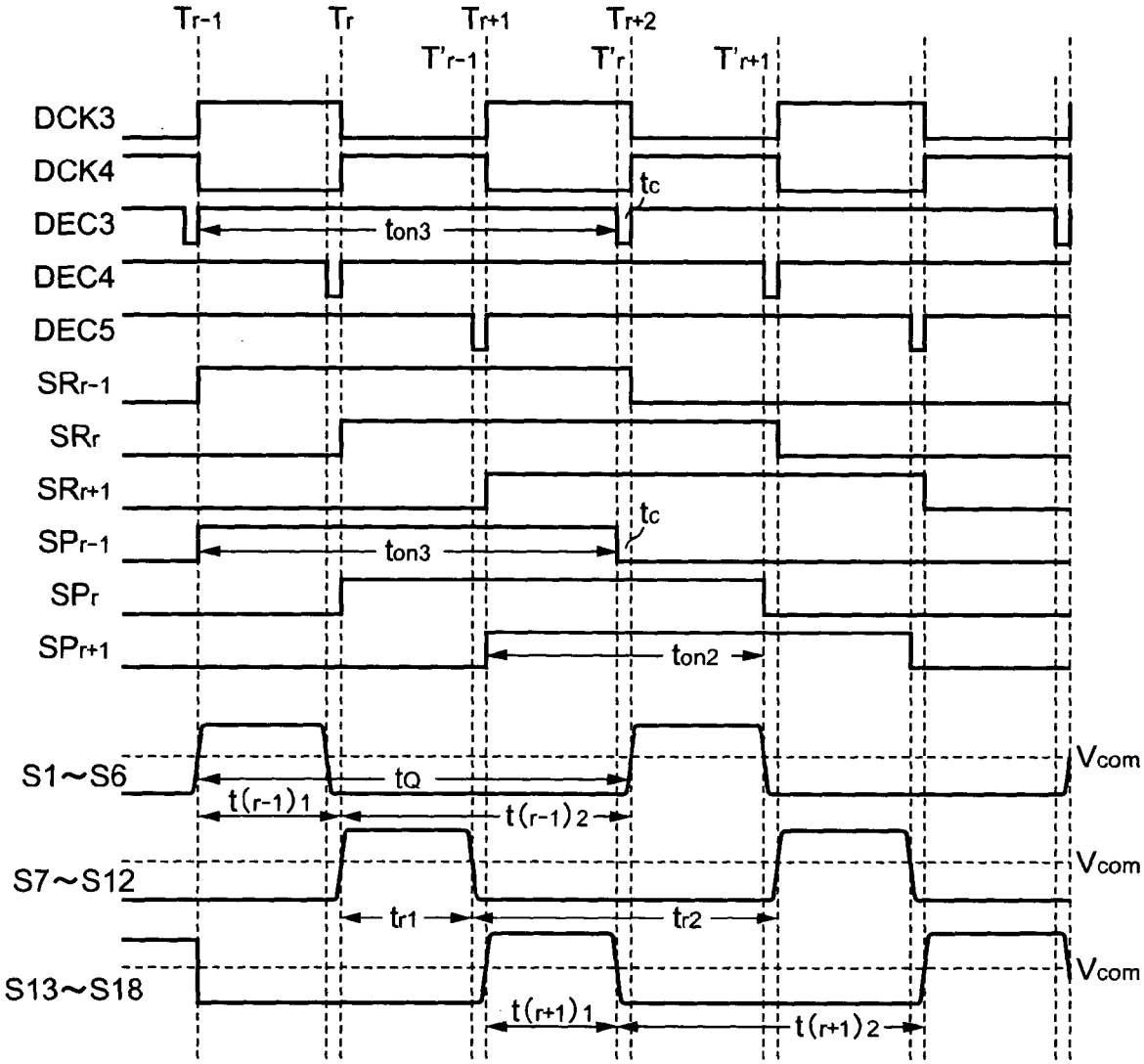
FIG. 19 is a detailed timing chart of a data driver of the liquid crystal display device.

FIG. 18 is a diagram showing an external driving circuit for supplying signals to a liquid crystal display device according to a fourth embodiment of the present invention, and FIG. 19 is a detailed timing chart of a data driver of the liquid crystal display device and a timing chart in a sub-frame in which pixel signals each having a negative polarity with respect to an electric potential of a counter electrode of a pixel matrix are written to corresponding pixels within the pixel matrix, respectively.

A point of difference between the constitution of this embodiment from that of the third embodiment is that the pixel signals each having the negative polarity with respect to the electric potential of the counter electrode of the pixel matrix are written to the corresponding pixels within the pixel matrix, respectively.

That is to say, the liquid crystal display device 10C of this embodiment is configured so that in the block sequential driving of the pixel matrix for each sub-frame in which the pixel matrix is subjected to the sub-frame inversion driving, the pixel signals which are to be applied to the data lines, respectively, are made positive in polarity with respect to the electric potential of the counter electrode of the pixel matrix to be applied to the data lines, respectively.

It is the same as that in the third embodiment that in a phase development/polarity inversion circuit 110C of an external driving circuit 104C, one frame is divided into four sub-frames, the 18 pixel signals of 18 phases are divided into three blocks every sub-frame, and each block is time-divided to be outputted.

It is also the same as that in the third embodiment that the format of such time-divided signals is such that with respect to the first block and the blocks arranged every three blocks from the first block of the blocks obtained through the three division of 18 phases, the first pixel signal to the sixth pixel signal, the 19-th pixel signal to the 24-th pixel signal, . . . within one horizontal time period are simultaneously, successively outputted (in parallel with one another); next, with respect to the second block and the blocks arranged every three blocks from the second block, the seventh pixel signal to the 12-th pixel signal, the 25-th pixel signal to the 30-th pixel signal, . . . within one horizontal time period are simultaneously, successively outputted (in parallel with one another); and next, with respect to the third block and the blocks arranged every three blocks from the third block, the 13-th pixel signal to the 18-th pixel signal, the 31-st pixel signal to the 36-th pixel signal, . . . are simultaneously, successively outputted (in parallel with one another).

It is also the same as that in the first embodiment that a set of 6 pixel signals are successively written as one block to the pixel matrix 12 of the liquid crystal display device 10C, and for a fixed switch-ON time period from a time instant of start of application of the 6 pixel signals of the certain one block to the corresponding data lines to a time instant of the sampling of the 6 pixel signals of the block concerned to the corresponding data lines, the switch array is held in the ON state.

A point of difference from the third embodiment is that for the front time period within this switch-ON time period, the above-mentioned 6 pixel signals to be outputted in parallel with one another are outputted as the signals which are opposite in polarity to the pixel signals which are made negative in polarity with respect to the electric potential of the counter electrode of the pixel matrix, and on the heels thereof, for a time period up to a time instant of end of the above-mentioned switch-ON time period after a lapse of the above-mentioned front time period, they are outputted as the pixel signals each having the negative polarity.

The pixel of 18 phases signals complying with such a signal format are supplied from the phase development/polarity inversion circuit 110C to the liquid crystal display device 10C.

Since a configuration of portions of this embodiment except that configuration is the same as that of the first embodiment, those portions are designated with the same reference numerals as those of FIG. 13 and FIG. 14, and the description thereof is omitted here.

Next, the operation of this embodiment will be described hereinbelow with reference to FIG. 18 and FIG. 19.

The pixel signals of 18 phases which are outputted from the phase development/polarity inversion circuit 110C of the external control circuit 104C to the pixel signal lines S1 to S18 are the same as those on the pixel signal lines S1 to S18 of the third embodiment except that as described above, they are the signals each having the negative polarity with respect to the electric potential of the counter electrode of the pixel matrix.

In addition, the operations of the data driver 14B and the gate driver 16 in this embodiment are also the same as those in the third embodiment.

It is also the same as that in the third embodiment that after the array switch $\mathbf{34}_r$ has been turned ON in accordance with the ON/OFF control signal $SP_r$ outputted from the scanning circuit 32B of the data driver 14B to apply the pixel signals on the corresponding 6 pixel signal lines to the corresponding 6 data lines $D_{6(r-1)+1}$ to $D_{6(r-1)+6}$, respectively, they are sampled to be held in the floating capacities of the data lines $D_{6(r-1)+1}$ to $D_{6(r-1)+6}$, respectively, to be applied to the corresponding 6 pixel electrodes $\mathbf{26}_{i(6(r-1)+1)}$ to $\mathbf{24}_{i(6(r-1)+6)}$ and the corresponding 6 storage capacities $\mathbf{24}_{i(6(r-1)+1)}$ to $\mathbf{24}_{i(6(r-1)+6)}$, respectively.

In that case as well, for time periods (time periods exhibited by $t_{(r-1)1}$, $t_{r1}$ and the like in FIG. 19) which do not substantially participate in the display of the corresponding pixels, the pixel signals which are applied to the data lines $D_{6(r-1)+1}$ to $D_{6(r-1)+6}$, respectively, are the signals which are opposite in polarity to the corresponding pixel signals each having the negative polarity with respect to the electric potential of the counter electrode 27 of the pixel matrix 12.

In addition, for time periods (time periods exhibited by $t_{(r-1)2}$, $t_{r2}$ and the like in FIG. 19) which substantially participate in the display of the corresponding pixels, the pixel signals which are applied to the data lines $D_{6(r-1)+1}$ to $D_{6(r-1)+6}$, respectively, are identical in polarity to the pixel signals each having the negative polarity with respect to the electric potential of the counter electrode 27 of the pixel matrix 12.

Consequently, the voltage fluctuation component of each of the 6 pixel signals which are held in the floating capacities of the data lines $D_{6(r-1)+1}$ to $D_{6(r-1)+6}$, respectively, after the above-mentioned sampling is cancelled by a value determined on the basis of the ratio between the signal time periods of the above-mentioned two kinds of pixel signals every data line of the data lines $D_{6(r-1)+1}$ to $D_{6(r-1)+6}$. As a result, quantities of voltage fluctuations of the 6 pixel signals which are held in the floating capacities of the data lines $D_{6(r-1)+1}$ to $D_{6(r-1)+6}$ are reduced.

Then, it is also the same as that in the third embodiment that at a time instant of end of the first horizontal time period after the operation for sampling and holding the pixel signals every block has been completed up to the final block, in response to the trailing edge of the gate pulse applied to the gate line G1, the corresponding pixel signals which are applied to from the pixel electrodes from the pixel electrode $\mathbf{26}_{11}$ to the pixel electrode $\mathbf{26}_{16}$ to the pixel electrodes from the pixel electrode $\mathbf{26}_{1(6(Q-1)+1)}$ to the pixel electrode $\mathbf{26}_{1(6(Q-1)+6)}$, and to from the storage capacities from the storage capacity 2411 to the storage capacity $\mathbf{24}_{16}$ to the storage capacities from the storage capacity $\mathbf{26}_{1(6(Q-1)+1)}$ to the storage capacity $\mathbf{26}_{1(6(Q-1)+6)}$ are sampled to be held in the corresponding pixel electrodes and storage capacities, and the display corresponding to the pixel signals being held is caused on the corresponding pixels.

It is also the same as that in the third embodiment that such holding and display are continued until the first horizontal time period of a next sub-frame has come and at a time instant of end thereof, the same sampling as that of the foregoing is carried out; the operation for the above-mentioned horizontal time period is repeatedly carried out the number of times equal to the number of horizontal time periods constituting a sub-frame; with respect to other sub-frames as well constituting a frame, the same operation is repeatedly carried out; and the driving in these sequential sub-frames is carried out with the same sub-frame inversion driving as the conventional frame inversion driving in which in a sub-frame just following a preceding sub-frame, the polarity of the whole sub-frame is inverted.

As described above, according to this embodiment, in the sub-frame inversion driving in which the pixel signals each having the negative polarity with respect to the electric potential of the counter electrode constituting the pixel matrix are applied, the pixel signals of 18 phases are divided into three blocks; and there is carried out the block sequential driving in which there is repeatedly carried out every block the operation in which for a time period which does not substantially participate in the display of the 6 pixel signals within each block, the pixel signals which are opposite in polarity to the pixel signals each having the negative polarity with respect to the electric potential of the counter electrode are applied to the data lines, respectively; the pixel signals each having the negative polarity with respect to the electric potential of the counter electrode continue to be applied to the data lines, respectively, until a time instant of the sampling after an elapse of the above-mentioned time period; and the pixel signals each having the negative polarity with respect to the electric potential of the counter electrode are sampled at a time instant of the sampling to be held in the floating capacities of the corresponding data lines, whereby the pixel signals held in the data lines, respectively, are sampled at the time instant of end of the horizontal time period concerned to be held in the corresponding pixel electrodes and storage capacities to thereby cause the display on the pixels.

As a result, when the pixel signals each having the negative polarity with respect to the electric potential of the counter electrode constituting the pixel matrix are written to the pixels through the data lines, respectively, the fluctuation of the signal voltages on the data lines is averaged to reduce quantities of voltage fluctuations of all the data lines.

Consequently, the transverse crosstalk which is caused in the conventional frame inversion driving is greatly reduced.

In addition, as described above, since prior to the application of the pixel signals to the data lines defined in blocks, the pixel signals of the polarity opposite thereto are necessarily applied four times for a horizontal time period, the same effects as those in the conventional precharge driving are obtained without taking a special precharge time period, and hence the longitudinal crosstalk is greatly reduced.

In addition, before a time instant of the sampling of the 6 pixel signals of the preceding block to the corresponding data lines by a predetermined time period, the 6 pixel signals of the same polarity of a block just following a preceding block are applied to the corresponding data lines, respectively. Thus, it is possible to greatly reduce signals (noises) which burst from the data line belonging to a block just following a preceding block into the data line belonging to the preceding block adjacent to the data line concerned, and hence it is possible to largely suppress the generation of the longitudinal streak nonuniformity.

In addition, with respect to reduction of flicker, enhancement of an aperture ratio, and improvement in operating speed of liquid crystal, the same effects as those of the third embodiment are obtained.

Illustrative embodiments of the present invention have been described above in detail with reference to the accompanying drawings. However, the present invention is not intended to be limited to those embodiments, and hence changes of the design within a scope not departing from the subject matter of the invention are contained in the invention would have been known to those of ordinary skill in the art.

For example, illustrative embodiments have been described with respect to the contents in which the driving in which before completion of application of the 6 pixel signals belonging to a preceding block with respect to two or three blocks to the data lines by a predetermined time period, the 6 pixel signals belonging to the block just following the preceding block concerned are started to be applied to the data lines, respectively, is successively, repeatedly carried out every two or three blocks to thereby cause predetermined display on the pixels of the pixel matrix. However, in a state in which the number of blocks is set to any other number and also the number of pixel signals is not changed or set to any other number, the present invention can also be implemented.

The ratio of a signal time period of the pixel signals opposite in polarity to the pixel signals which are continuously applied from the pixel signal lines to the corresponding data lines, respectively, until a time period of the sampling to a signal time period of the pixel signals of the original polarity is determined on the basis of the degree to which the fluctuation of the pixel signals in the corresponding data lines concerned is averaged so that a quantity which the fluctuation mean value gives the display of the pixels may be reduced.

In addition, the present invention can be implemented in such a way that after a pixel signal opposite in polarity to a pixel signal supplied through a first pixel signal line and a pixel signal of the original polarity have been precedingly applied from the first pixel signal line to a first data line, the application of the pixel signal from a second pixel signal line to a second data line which is carried out right after the above-mentioned preceding application of the pixel signal from the first pixel signal line to the first data line is carried out before a time instant when the above-mentioned pixel signal precedingly applied to the first data line is sampled to be held in a floating capacity of the first data line by a time period enough to prevent noises from being transmitted from the above-mentioned second data line to the above-mentioned first data line.

In addition, pixel signals opposite in polarity to pixel signals of an original polarity, and the pixel signals of the original polarity are applied from pixel signal lines to corresponding data lines, respectively, and both these pixel signals are sampled to the corresponding data lines to be held, respectively, to thereby average the fluctuation of the pixel signals, whereby the present invention can also be applied to the driving of a pixel matrix which becomes useful in the display on the pixels concerned.

Moreover, in any of the above-mentioned embodiments, the description has been given with respect to the example in which the sampling is carried out twice to write the pixel signals to the corresponding pixels, respectively. However, the present invention may also be implemented by being applied to a liquid crystal display device for sampling pixel signals once to write the sampled pixel signals to corresponding pixels, respectively.

In addition, while the description has been given with respect to the example in which one frame is divided into four sub-frames, it is to be understood that the number of division of one frame into sub-frames may be set to a suitable number for implementation of the present invention.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein but is to be accorded the widest scope as defined by the limitations of the claims and equivalent.

What is claimed is:

1. A liquid crystal display device driving method wherein said liquid crystal display device comprises:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed;

a liquid crystal sandwiched between said matrix substrate and a counter substrate on which a counter electrode common to all said pixels on said matrix substrate is arranged, wherein said data driver circuit comprises N switching blocks each having M switching elements, a scanning circuit for outputting an open/close control signal for each switching block, and M×P (P is a natural number) video signal wirings forming one set of M×N video signals from said video signal corresponding to a first pixel time period up to said video signal corresponding to a final pixel time period within the horizontal time period as one set; said M video signal wirings of an i-th set (one of i=1, 2, . . . , P) of the M×P video signal wirings are respectively connected to input terminals of the M switching elements of the i-th switching block, when viewed from the first switching block, and wherein said data lines are divided into blocks each having M data lines, wherein said M data lines of each block are respectively connected to output terminals of said M switching elements within each of the switching blocks from a first switching block up to a final switching block of the N switching blocks defined in blocks from a first block up to a final block, said driving method comprising:

an outputting step wherein said scanning circuit outputs the open/close control signal synchronously with the M video signals supplied successively every P sets, and successively outputs every set of the P sets simultaneously within the set through the M×P video signal wirings in an arbitrary horizontal time period;

a sampling step wherein the M video signals, which are supplied successively every P sets, successively every set of the P sets and simultaneously within the set, are sampled to the M data lines connected to the M switching elements so as to simultaneously conduct in the M switching elements of the switching block, wherein at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements simultaneously conduct subsequent to M switching elements of the switching block which are formerly caused to simultaneously conduct with the open/close control signal supplied from the scanning circuit; and a writing step wherein the M video signals that are sampled individually are respectively written to the M pixels of the set including the M pixel transistors, and are caused to simultaneously conduct through the M pixel transistors of the set every set of M pixel transistors which are connected to the gate lines through which the gate driver circuit supplies the gate signal during the arbitrary horizontal time period and which simultaneously conduct, wherein the M video signals supplied through the M video signal wirings for each set of the P sets are the video signals the polarity of which is changed with respect to the counter electrode between the first time period and a second time period as the remaining time period of the conduction time period following the first time period.

2. The method of driving a liquid crystal display device according to claim 1, characterized in that a time instant when the polarity of each video signal changes between the first time period and the second time period is a time instant which precedes a time instant when the switching elements of the switch block transition from the conducting state to the nonconducting state in a predetermined time period.

3. The method of driving a liquid crystal display device according to claim 1, characterized in that the ratio of the first time period to the second time period is a predetermined ratio which acts to reduce in quantity of voltage fluctuations of the video signals on all of the data lines.

4. The method of driving a liquid crystal display device according to claim 1, characterized in that the first time period is a time period which is equal to or shorter than the first half of the conduction time period, and the second time period is the remaining time period just following the time period which is equal to or shorter than the first half thereof.

5. A liquid crystal display device driving method wherein said liquid crystal display device comprises:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed, a liquid crystal sandwiched between said matrix substrate and a counter substrate on which a counter electrode common to all said pixels on said matrix substrate is arranged;

wherein said data driver circuit comprises N switching block each having M switching elements, a scanning circuit for outputting an open/close control signal for each switching block, and 2M video signal wirings forming one set of said 2M video signals from said video signal corresponding to a first pixel time period up to said video signal corresponding to a final pixel time period within the horizontal time period as one set; said M video signal wirings of an i-th set (one of i=1, 2, . . . , P) of the 2M video signal wirings are respectively connected to input terminals of the M switching elements of the i-th switching block; and wherein said data lines are divided into blocks each having said M data lines, wherein said M data lines of each block are respectively connected to output terminals of said M switching elements within each of the switching blocks from a first switching block up to a final switching block of the N switching blocks defined in blocks from a first block up to a final block, said driving method comprising:

an outputting step wherein said scanning circuit outputs the open/close control signal synchronously with the M video signals supplied successively every P sets, and successively outputs every set of the P sets simultaneously within the set through the 2M video signal wirings in an arbitrary horizontal time period, a sampling step wherein the M video signals, which are supplied successively every P sets, successively every set of the two sets and simultaneously within the set, are sampled to the M data lines connected to the M switching elements so as to simultaneously conduct in the M switching elements of the switching block; and a writing step wherein the M video signals that are sampled individually are respectively written to the M pixels of the set including the M pixel transistors, and are caused to simultaneously conduct through the M pixel transistors of the set every set of M pixel transistors which are connected to the gate lines through which the gate driver circuit supplies the gate signal during the arbitrary horizontal time period and which simultaneously conduct, wherein at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements simultaneously conduct subseQuent to M switching elements of the switching block which are formerly caused to simultaneously conduct with the open/close control signal supplied from the scanning circuit, and wherein the M video signals supplied through the M video signal wirings for each set of the P sets are the video signals the polarity of which is changed with respect to the counter electrode between the first time period and a second time period as the remaining time period of the conduction time period following the first time period.

6. The method of driving a liquid crystal display device according to claim 1, characterized in that a time instant when the polarity of each video signal changes between the first time period and the second time period is a time instant which precedes a time instant when the switching elements of the switch block transition from the conducting state to the nonconducting state in a predetermined time period.

7. The method of driving a liquid crystal display device according to claim 5, characterized in that the ratio of the first time period to the second time period is a predetermined ratio which acts to reduce in quantity of voltage fluctuations of the video signals on all of the data lines.

8. The method of driving a liquid crystal display device according to claim 5, characterized in that the first time period is a time period which is equal to or shorter than the first half of the conduction time period, and the second time period is the remaining time period just following the time period which is equal to or shorter than the first half thereof.

9. A liquid crystal display device comprising:

a pixel matrix having pixels including gate lines, data lines disposed orthogonally to said gate lines, and pixel transistors arranged at intersections between said gate lines and said data lines:

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed; and a liquid crystal sandwiched between said matrix substrate and a counter substrate on which a counter electrode common to all said pixels on said matrix substrate is arranged, wherein said data driver circuit comprises by N switching blocks each having M switching elements, a scanning circuit for outputting an open/close control signal for each switching block, and M×P (P is a natural number) video signal wirings forming one set of said M×N video signals from said video signal corresponding to a first pixel time period up to said video signal corresponding to a final pixel time period within the horizontal time period as one set, said M video signal wirings of an i-th set (one of i=1, 2, . . . , P) of the M×P video signal wirings are respectively connected to input terminals of the M switching elements of the i-th switching block, wherein said data lines are divided into blocks each having M data lines, wherein said M data lines of each block are respectively connected to output terminals of said M switching elements within each of the switching blocks from a first switching block up to a final switching block of the N switching blocks defined in blocks from a first block up to a final block, wherein the scanning circuit outputs the open/close control signal synchronously with the M video signals supplied successively every P sets, and successively outputs every set of the P sets simultaneously within the set through the M×P video signal wirings in an arbitrary horizontal time period, wherein the M video signals, which are supplied successively every P sets, successively every set of the P sets and simultaneously within the set, are sampled to the M data lines connected to the M switching elements which simultaneously conduct in the M switching elements of the switching block, wherein at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements simultaneously conduct on the heels of M switching elements of the switching block which are formerly caused to simultaneously conduct with the open/close control signal supplied from the scanning circuit, wherein the M video signals that are sampled individually are respectively written to the M pixels of the set including the M pixel transistors which simultaneously conduct through the M pixel transistors of the set every set of M pixel transistors which are connected to the gate lines through which the gate driver circuit supplies the gate signal during the arbitrary horizontal time period and which simultaneously conduct, and wherein the M video signals supplied through the M video signal wirings for each set of the P sets are the video signals the polarity of which is changed with respect to the counter electrode between the first time period and a second time period as the remaining time period of the conduction time period following the first time period.

10. The liquid crystal display device according to claim 9, characterized in that the ratio of the first time period to the second time period is a predetermined ratio which acts to reduce in quantity of voltage fluctuations of the video signals on all the data lines.

11. The liquid crystal display device according to claim 9, characterized in that the first time period is a time period which is equal to or shorter than the first half of the conduction time period, and the second time period is the remaining time period just following the time period which is equal to or shorter than the first half thereof.

12. The liquid crystal display device according to claim 9, characterized in that the polarities of the video signals which are written to all the pixels are made either the same polarity with respect to the counter electrode or the opposite polarity with respect to the counter electrode for the preceding frame time period of the two preceding and following frame time periods when the video signals for one screen are successively displayed, wherein the polarities of the video signals which are written to all the pixels are made either the opposite polarity the polarity which is taken for the preceding time period or the same polarity for the following time period.

13. The liquid crystal display device according to claim 9, characterized in that a P×Q or two video signal wirings are adapted to supply therethrough the video signals for one screen at a second frame frequency at least two times as high as a first frame frequency of a signal source for outputting the video signals for one picture at the first frame frequency so that the video signals are written to all the pixels two or more times.

14. The liquid crystal display device according to claim 9, characterized in that a TFT constituting the pixel switching element, and TFTs constituting the data driver circuit and the gate driver circuit comprise of polysilicon TFTs.

15. The liquid crystal projector apparatus comprising the liquid crystal display device according to claim 9.

16. A liquid crystal display device comprising:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed; and a liquid crystal sandwiched between said matrix substrate and a counter substrate on which a counter electrode common to all said pixels on said matrix substrate is arranged, wherein said data driver circuit comprises by N switching block each having M switching elements, a scanning circuit for outputting an open/close control signal for each switching block, and 2M video signal wirings forming one set of said M×N video signals from said video signal corresponding to a first pixel time period up to said video signal corresponding to a final pixel time period within the horizontal time period as one set; said M video signal wirings of an i-th set (one of i=1, 2, . . . , P) of the 2M video signal wirings are respectively connected to input terminals of the M switching elements of the i-th switching block, wherein said data lines are divided into blocks each having said M data lines, wherein said M data lines of each block are respectively connected to output terminals of said M switching elements within each of the switching blocks from a first switching block up to a final switching block of the N switching blocks defined in blocks from a first block up to a final block, wherein the scanning circuit outputs the open/close control signal synchronously with the M video signals supplied successively every two sets, and successively outputs every set of the two sets simultaneously within the set through the 2M video signal wirings in an arbitrary horizontal time period, wherein the M video signals, which are supplied successively every two sets, successively every set of the two sets and simultaneously within the set, are sampled to the M data lines connected to the M switching elements which are caused to simultaneously conduct in the M switching elements of the switching block, wherein the M video signals that are sampled individually are respectively written to the M pixels of the set including the M pixel transistors which simultaneously conduct through the M pixel transistors of the set every set of M pixel transistors which are connected to the gate lines through which the gate driver circuit supplies the gate signal during, the arbitrary horizontal time period and which simultaneously conduct, wherein at a time instant when a first time period of a conduction time period when each of the M switching elements is in the conducting state elapses from a time instant of start of the conduction of the M switching elements of the switching block which are formerly caused to simultaneously conduct with the open/close control signal supplied from the scanning circuit, the open/close control signal is supplied from the scanning circuit to the switching block in which the M switching elements simultaneously conduct subsequent to M switching elements of the switching block which are formerly caused to simultaneously conduct with the open/close control signal supplied from the scanning circuit, and wherein the M video signals supplied through the M video signal wirings for each set of the P sets are the video signals the polarity of which is changed with respect to the counter electrode between the first time period and a second time period as the remaining time period of the conduction time period following the first time period.

17. The liquid crystal display device according to claim 9, characterized in that a time instant when the polarity of each video signal changes between the first time period and the second time period, is a time instant which precedes a time instant when the switching elements of the switch block transition from the conducting state to the nonconducting state in a predetermined time period.

18. The liquid crystal display device according to claim 16, characterized in that a time instant when the polarity of each video signal changes between the first time period and the second time period is a time instant which precedes a time instant when the switching elements of the switch block transition from the conducting state to the nonconducting state in a predetermined time period.

19. The liquid crystal display device according to claim 16, characterized in that the ratio of the first time period to the second time period is a predetermined ratio which acts to reduce in quantity of voltage fluctuations of the video signals on all the data lines.

20. The liquid crystal display device according to claim 16, characterized in that the first time period is the time period which is equal to or shorter than the first half of the conduction time period, and the second time period is the remaining time period just following the time period which is equal to or shorter than the first half thereof.

21. The liquid crystal display device according to claim 16, characterized in that the polarities of the video signals which are written to all the pixels are made either the same polarity with respect to the counter electrode or the opposite polarity with respect to the counter electrode for the preceding frame time period of the two preceding and following frame time periods when the video signals for one screen are successively displayed, wherein the polarities of the video signals which are written to all the pixels are made either the opposite polarity from the polarity which is taken for the preceding time period or the same polarity for the following time period.

22. The liquid crystal display device according to claim 16, characterized in that a P×Q or two video signal wirings are adapted to supply therethrough the video signals for one screen at a second frame frequency at least two times as high as a first frame frequency of a signal source for outputting the video signals for one picture at the first frame frequency so that the video signals are written to all the pixels two or more times.

23. A liquid crystal display device driving method, wherein said liquid crystal display device comprises:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed;

a liquid crystal sandwiched between said matrix substrate and a counter substrate on which a counter electrode common to all said pixels on said matrix substrate is arranged;

wherein said data driver circuit is comprised by video signal wirings through which the video signals from the video signal corresponding to the first time period up to the video signal corresponding to the final time period are adapted to be supplied every horizontal time period;

switching elements for connecting the video signal wirings to the data lines to which the video signals are to be respectively supplied; and a scanning circuit for outputting an open/close control signal in accordance with which the switching elements are caused to conduct, the open/close control signal being supplied from the scanning circuit to the switching elements to which the video signals are supplied synchronously with the video signals supplied through the video signal wirings, respectively, said driving method comprising:

a step of supplying wherein the video signals supplied through the video signal wirings being sampled to the data lines to which the video signals are to be supplied in the switching elements which are caused to conduct with the open/close control signal, and a step of sampling wherein the sampled video signals being passed through the pixel transistors which are connected to the gate line through which the gate signal is adapted to be supplied by the gate driver circuit and which are caused to conduct to be written to the pixels including the pixel transistors, respectively, for a supply horizontal period when the video signals are supplied to the video signal wirings, respectively, wherein the video signals which are to be supplied to the video signal wirings to which the switching elements caused to conduct in accordance with the open/close control signal are connected are the video signals the polarity of which is changed with respect to the counter electrode between the first time period, which is in a conduction time period when the switching elements are caused to conduct with the open/close control signal, and a second time period as the remaining time period of the conduction time period following the first time period.

24. The method of driving a liquid crystal display device according to claim 23, characterized in that a time instant when the polarity of each video signal changes between the first time period and the second time period, is a time instant which precedes a time instant when the switching elements of the switch block transition from the conducting state to the nonconducting state in a predetermined time period.

25. The method of driving a liquid crystal display device according to claim 23, characterized in that the ratio of the first time period to the second time period is a predetermined ratio which acts to reduce voltage fluctuations of the video signals.

26. The method of driving a liquid crystal display device according to claim 23, characterized in that the first time period is the time period which is equal to or shorter than the first half of the conduction time period, and the second time period is the remaining time period just following the time period which is equal to or shorter than the first half thereof.

27. A liquid crystal display device driving method, wherein said liquid crystal display device comprises:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed;

a liquid crystal sandwiched between said matrix substrate and a counter substrate on which a counter electrode common to all said pixels on said matrix substrate is arranged;

wherein said data driver circuit is comprised by video signal wirings through which the video signals from the video signal corresponding to the first time period up to the video signal corresponding to the final time period are adapted to be supplied every horizontal time period;

switching elements for connecting the video signal wirings to the data lines to which the video signals are to be respectively supplied; and a scanning circuit for outputting an open/close control signal in accordance with which the switching elements are caused to conduct, the open/close control signal being supplied from the scanning circuit to the switching elements to which the video signals are supplied synchronously with the video signals supplied through the video signal wirings, respectively, said driving method comprising:

a step of supplying wherein the video signals supplied through the video signal wirings being sampled to the data lines to which the video signals are to be supplied in the switching elements which are caused to conduct with the open/close control signal, and a step of sampling wherein the sampled video signals being passed through the pixel transistors which are connected to the gate line through which the gate signal is adapted to be supplied by the gate driver circuit and which are caused to conduct to be written to the pixels including the pixel transistors, respectively, for a supply horizontal period when the video signals are supplied to the video signal wirings, respectively, wherein at a time instant when a first time period of a conduction time period when the switching elements are in the conducting state elapses from a time instant of start of the conduction of the switching elements which are caused to conduct with the open/close control signal supplied from the scanning circuit, the open/close control signal is supplied from the scanning circuit to the switching elements which are to be caused to conduct on the heels of the switching elements which are caused to conduct in accordance with the open/close control signal supplied from the scanning circuit; and the video signals which are to be supplied to the video signal wirings to which the switching elements caused to conduct in accordance with the open/close control signal supplied from the scanning circuit are connected are the video signals the polarity of which is changed with respect to the counter electrode between the first time period and a second time period as the remaining time period of the conduction time period following the first time period.

28. The method of driving a liquid crystal display device according to claim 27, characterized in that a time instant when the polarity of each video signal changes between the first time period and the second time period, is a time instant which precedes a time instant when the switching elements of the switch block transition from the conducting state to the nonconducting state in a predetermined time period.

29. The method of driving a liquid crystal display device according to claim 27, characterized in that the ratio of the first time period to the second time period is a predetermined ratio which acts to reduce voltage fluctuations of the video signals.

30. The method of driving a liquid crystal display device according to claim 27, characterized in that the first time period is the time period which is equal to or shorter than the first half of the conduction time period, and the second time period is the remaining time period just following the time period which is equal to or shorter than the first half thereof.

31. A liquid crystal display device comprising:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed;

a liquid crystal sandwiched between said matrix substrate and a counter substrate on which a counter electrode common to all said pixels on said matrix substrate is arranged;

wherein said data driver circuit comprises by video signal wirings through which the video signals from the video signal corresponding to the first time period up to the video signal corresponding to the final time period are adapted to be supplied every horizontal time period;

switching elements for connecting the video signal wirings to the data lines to which the video signals are to be respectively supplied; and a scanning circuit for outputting an open/close control signal in accordance with which the switching elements are caused to conduct, the open/close control signal being supplied from the scanning circuit to the switching elements to which the video signals are supplied synchronously with the video signals supplied through the video signal wirings, respectively, the video signals supplied through the video signal wirings being sampled to the data lines to which the video signals are to be supplied in the switching elements which are caused to conduct with the open/close control signal, and the sampled video signals being passed through the pixel transistors which are connected to the gate line through which the gate signal is adapted to be supplied by the gate driver circuit and which are caused to conduct to be written to the pixels including the pixel transistors, respectively, for a supply horizontal period when the video signals are supplied to the video signal wirings, respectively, wherein the video signals which are to be supplied to the video signal wirings to which the switching elements caused to conduct in accordance with the open/close control signal are connected are the video signals the polarity of which is changed with respect to the counter electrode between the first time period, which is in a conduction time period when the switching elements are caused to conduct with the open/close control signal, and a second time period as the remaining time period of the conduction time period following the first time period.

32. The liquid crystal display device according to claim 31, characterized in that a time instant when the polarity of each video signal changes between the first time period and the second time period, is a time instant which precedes a time instant when the switching elements of the switch block transition from the conducting state to the nonconducting state in a predetermined time period.

33. The liquid crystal display device according to claim 31, characterized in that the ratio of the first time period to the second time period is a predetermined ratio which acts to reduce voltage fluctuations of the video signals.

34. The liquid crystal display device according to claim 31, characterized in that the first time period is the time period which is equal to or shorter than the first half of the conduction time period, and the second time period is the remaining time period just following the time period which is equal to or shorter than the first half thereof.

35. A liquid crystal display device comprising:

a pixel matrix having pixels including gate lines, data lines disposed orthogonally to said gate lines, and pixel transistors arranged at intersections between said gate lines and said data lines;

a data driver circuit for supplying video signals from a video signal corresponding to a first pixel time period up to a video signal corresponding to a final pixel time period to different data lines every horizontal time period;

a gate driver circuit for supplying a gate signal to a corresponding gate line every horizontal time period;

a matrix substrate on which said data driver circuit and said gate driver circuit are formed;

a liquid crystal sandwiched between said matrix substrate and a counter substrate on which a counter electrode common to all said pixels on said matrix substrate is arranged;

wherein said data driver circuit comprises by video signal wirings through which the video signals from the video signal corresponding to the first time period up to the video signal corresponding to the final time period are adapted to be supplied every horizontal time period;

switching elements for connecting the video signal wirings to the data lines to which the video signals are to be respectively supplied; and a scanning circuit for outputting an open/close control signal in accordance with which the switching elements are caused to conduct, the open/close control signal being supplied from the scanning circuit to the switching elements to which the video signals are supplied synchronously with the video signals supplied through the video signal wirings, respectively, the video signals supplied through the video signal wirings being sampled to the data lines to which the video signals are to be supplied in the switching elements which are caused to conduct with the open/close control signal, and the sampled video signals being passed through the pixel transistors which are connected to the gate line through which the gate signal is adapted to be supplied by the gate driver circuit and which are caused to conduct to be written to the pixels including the pixel transistors, respectively, for a supply horizontal period when the video signals are supplied to the video signal wirings, respectively, wherein at a time instant when a first time period of a conduction time period when the switching elements are in the conducting state elapses from a time instant of start of the conduction of the switching elements which are caused to conduct with the open/close control signal supplied from the scanning circuit, the open/close control signal is supplied from the scanning circuit to the switching elements which are to be caused to conduct on the heels of the switching elements which are caused to conduct in accordance with the open/close control signal supplied from the scanning circuit; and the video signals which are to be supplied to the video signal wirings to which the switching elements caused to conduct in accordance with the open/close control signal supplied from the scanning circuit are connected are the video signals the polarity of which is changed with respect to the counter electrode between the first time period and a second time period as the remaining time period of the conduction time period following the first time period.

36. The liquid crystal display device according to claim 35, characterized in that a time instant when the polarity of each video signal changes between the first time period and the second time period, is a time instant which precedes a time instant when the switching elements of the switch block transition from the conducting state to the nonconducting state in a predetermined time period.

37. The liquid crystal display device according to claim 35, characterized in that the ratio of the first time period to the second time period is a predetermined ratio which acts to reduce voltage fluctuations of the video signals.

38. The liquid crystal display device according to claim 35, characterized in that the first time period is the time period which is equal to or shorter than the first half of the conduction time period, and the second time period is the remaining time period just following the time period which is equal to or shorter than the first half thereof.

* * * * *

UNITED STATES PATENT AND TRADEMARK OFFICE

CERTIFICATE OF CORRECTION

PATENT NO. : 7,148,871 B2
APPLICATION NO. : 10/656297
DATED : December 12, 2006
INVENTOR(S) : Hiroyuki Sekine It is certified that error appears in the above-identified patent and that said Letters Patent is hereby corrected as shown below:

Col. 9, Line 11 delete "front", insert --first--.

Col. 25, Line 5 delete "$36_{r+1}$ of the cascade-connected (Q+1)", insert --$36_{r+1}$ of the cascade-connected (Q+1)--.

Signed and Sealed this

Fourteenth Day of October, 2008

JON W. DUDAS
*Director of the United States Patent and Trademark Office*